US010549553B2

(12) United States Patent
Ito

(10) Patent No.: US 10,549,553 B2
(45) Date of Patent: Feb. 4, 2020

(54) PRINTING APPARATUS AND CONTROL METHOD

(71) Applicant: CANON KABUSHIKI KAISHA, Tokyo (JP)

(72) Inventor: Masashi Ito, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 15/591,322

(22) Filed: May 10, 2017

(65) Prior Publication Data

US 2017/0334219 A1 Nov. 23, 2017

(30) Foreign Application Priority Data

May 23, 2016 (JP) ..... 2016-102760

(51) Int. Cl.
*B41J 11/00* (2006.01)
*B41J 13/00* (2006.01)
*B41J 11/04* (2006.01)

(52) U.S. Cl.
CPC ..... *B41J 11/0055* (2013.01); *B41J 13/0009* (2013.01); *B41J 11/04* (2013.01)

(58) Field of Classification Search
CPC ..... B41J 111/0055; B41J 113/0009; B41J 113/0018; B41J 11/0055; B41J 11/04; B41J 13/0009; B41J 13/10; B41J 13/0018; B41J 13/0027; B65H 5/24; B65H 7/02; B65H 9/006; B65H 2513/40; B65H 2513/50; B65H 5/068; B65H 5/08; B65H 29/02
See application file for complete search history.

(56) References Cited

U.S. PATENT DOCUMENTS 8,807,556 B2 8/2014 Sugiyama et al.
9,370,946 B2 6/2016 Nishida et al.
9,597,900 B2 3/2017 Tanaami et al.
9,956,793 B2 * 5/2018 Yatsunami ..... B41J 11/04

FOREIGN PATENT DOCUMENTS

JP 2015-229555 A 12/2015

* cited by examiner

*Primary Examiner* — Thinh H Nguyen
(74) *Attorney, Agent, or Firm* — Venable LLP

(57) ABSTRACT

A printing apparatus includes a feeding unit, a pair of rollers, a printing unit, and a control unit. The control unit can execute skew correction. The control unit can execute control to convey a preceding printing medium and a succeeding printing medium by the pair of rollers in a state in which a trailing edge portion of the preceding printing medium and a leading edge portion of the succeeding printing medium overlap. The control unit sets an execution timing of the skew correction for the succeeding printing medium based on positions of the preceding printing medium and the succeeding printing medium if a predetermined condition is met. The predetermined condition is that the preceding printing medium reaches a position at which a remaining print range for the preceding printing medium equals a predetermined print range.

4 Claims, 19 Drawing Sheets

PRINTING APPARATUS AND CONTROL METHOD

BACKGROUND OF THE INVENTION

Field of the Invention

The present invention relates to a printing apparatus and a control method.

Description of the Related Art

As a method of improving the printing speed of a printing apparatus, overlap continuous feeding of printing media has been proposed. Overlap continuous feeding is a conveying method of overlaying the leading edge of a succeeding printing medium on the trailing edge of a preceding printing medium and conveying them in this state when continuously printing images on a plurality of printing media (for example, Japanese Patent Laid-Open No. 2015-229555). The overlap continuous feeding can further improve throughput as compared to a conveying method of starting feeding of a succeeding printing medium after the end of printing on a preceding printing medium or a conveying method of continuously conveying printing media while reducing the gap between them. Japanese Patent Laid-Open No. 2015-229555 proposes executing overlap continuous feeding on condition that printing on the preceding printing medium ends.

If a printing medium is conveyed in a tilting state, the image print position may shift. As a measure against this, skew correction is performed to correct the tilt of the printing medium by abutting the leading edge of the printing medium against a pair of rollers. The skew correction timing for the succeeding printing medium needs to be set appropriately in association with overlap continuous feeding of the preceding printing medium.

SUMMARY OF THE INVENTION

The present invention improves the overlap continuous feeding technique for printing media.

According to an aspect of the present invention, there is provided a printing apparatus comprising: a feeding unit configured to feed a printing medium; a conveying unit configured to convey the printing medium fed by the feeding unit; a printing unit configured to perform printing on the printing medium conveyed by the conveying unit; and a control unit configured to control the feeding unit and the conveying unit, wherein the conveying unit includes a pair of rollers, the control unit can execute skew correction of driving the feeding unit and causing a leading edge of the printing medium to abut against a nip portion of the pair of rollers which stops, the control unit can execute control to convey a preceding printing medium and a succeeding printing medium by the pair of rollers in a state in which a trailing edge portion of the preceding printing medium and a leading edge portion of the succeeding printing medium overlap, the control unit sets an execution timing of the skew correction for the succeeding printing medium based on positions of the preceding printing medium and the succeeding printing medium if a predetermined condition is met, and the predetermined condition is that the preceding printing medium reaches a position at which a remaining print range for the preceding printing medium by the printing unit equals a predetermined print range.

Further features of the present invention will become apparent from the following description of exemplary embodiments (with reference to the attached drawings).

DESCRIPTION OF THE EMBODIMENTS

First Embodiment

Figure 1:
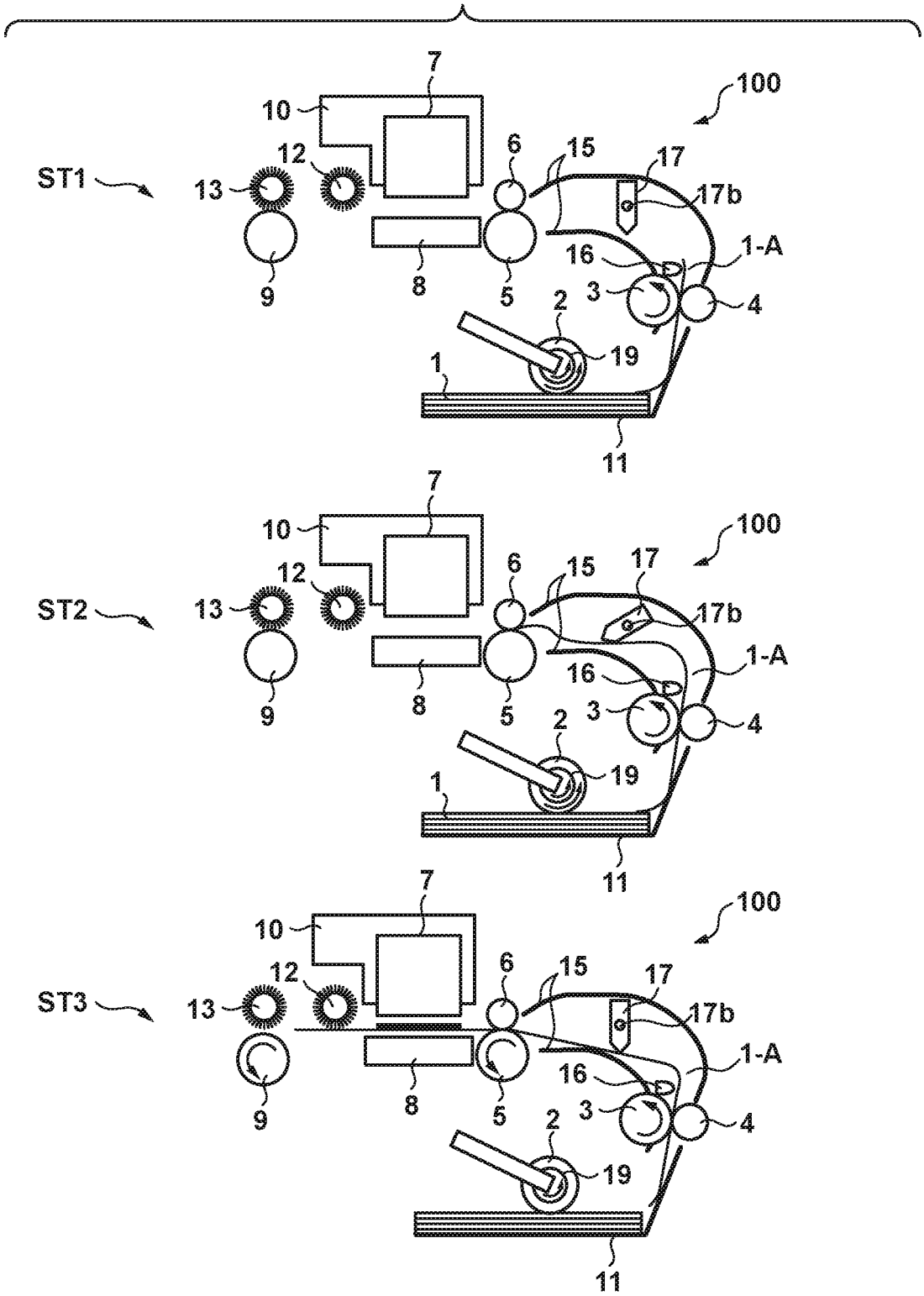
FIG. 1 is an explanatory view of the operation of a printing apparatus according to an embodiment of the present invention.
Figure 2:
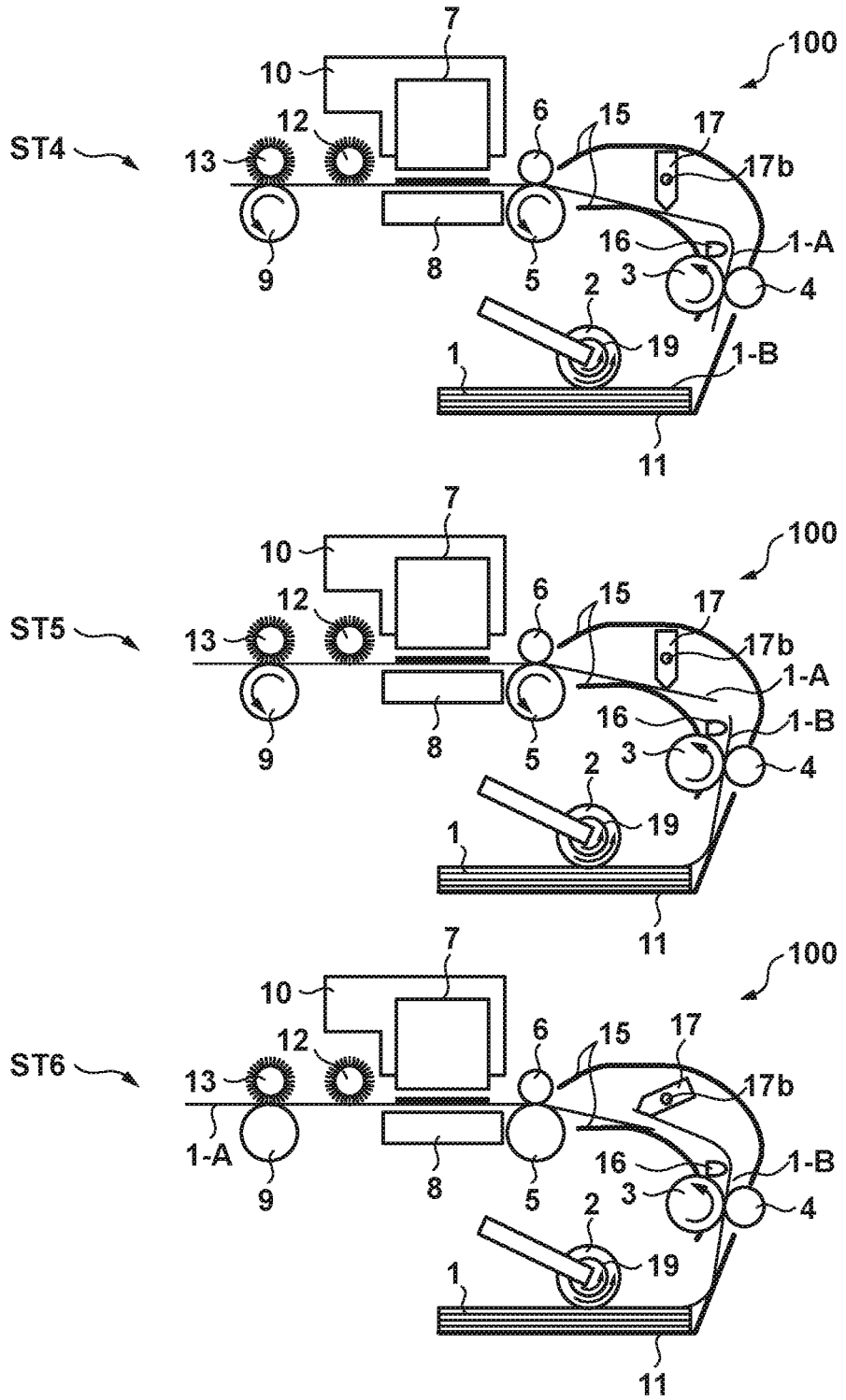
FIG. 2 is an explanatory view of the operation of the printing apparatus shown in FIG. 1.
Figure 3:
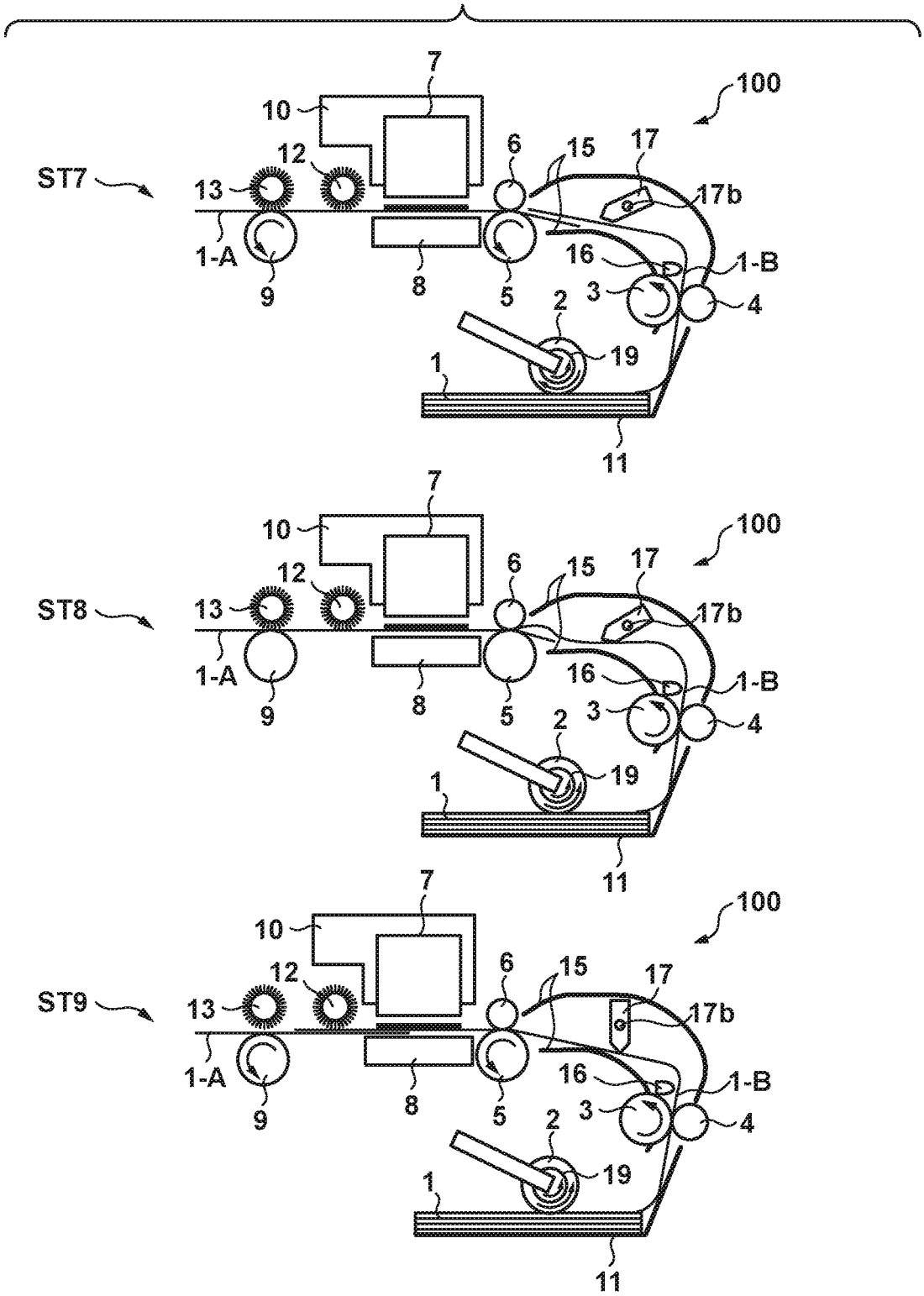
FIG. 3 is an explanatory view of the operation of the printing apparatus shown in FIG. 1.

FIGS. 1 to 3 are explanatory views of the operation of a printing apparatus 100 according to an embodiment of the present invention, particularly, explanatory views of an overlap continuous feeding operation. FIGS. 1 to 3 schematically illustrate the sectional structure of the printing apparatus 100. In this embodiment, a case in which the present invention is applied to a serial type inkjet printing apparatus will be described. However, the present invention is also applicable to a printing apparatus of another type.

Note that "print" includes not only formation of significant information such as a character or graphic pattern but also formation of an image, design, or pattern on print media in a broader sense regardless of whether the information is significant or insignificant or has become obvious to allow human visual perception. Additionally, in this embodiment, "print media" are assumed to be paper sheets but may be fabrics or plastic films. A sheet-shaped printing medium will be referred to as a print sheet here.

Before an explanation of the operation of the printing apparatus 100, the arrangement will be described mainly with reference to a state ST1 shown in FIG. 1. The printing apparatus 100 includes a feeding tray 11 (stacking unit) capable of stacking a plurality of print sheets 1, a printing unit configured to perform printing on the print sheet 1, and a conveying device capable of conveying the print sheet 1 on the feeding tray 11.

The printing unit includes a printhead 7 and a carriage 10. The printhead 7 performs printing on the print sheet 1. In this embodiment, the printhead 7 is an inkjet printhead that performs printing on the print sheet 1 by discharging ink. The printhead 7 includes a plurality of arrays of ink discharge nozzles. Each array includes a plurality of ink discharge nozzles. The plurality of ink discharge nozzles are arranged in the conveying direction of the print sheet 1. The length of a range in which the printhead 7 can print at once in the conveying direction is sometimes called a nozzle length. A platen 8 that supports the back surface of the print sheet 1 is arranged at a position facing the printhead 7. The carriage 10 with the printhead 7 mounted on it moves in a direction crossing the conveying direction.

The conveying device is roughly divided into a feeding mechanism, a conveying mechanism, and a discharging mechanism. The feeding mechanism feeds the print sheet 1 stacked on the feeding tray 11 to the conveying mechanism, and the conveying mechanism conveys the fed print sheet 1 to the discharging mechanism. The discharging mechanism conveys the print sheet 1 to the outside of the printing apparatus 100. Conveyance of the print sheet 1 under printing is mainly performed by the conveying mechanism. The print sheet 1 is sequentially conveyed by the feeding mechanism, the conveying mechanism, and the discharging mechanism in this way. The feeding mechanism side will be referred to as an upstream side in the conveying direction, and the discharging mechanism side will be referred to as a downstream side in the conveying direction.

The feeding mechanism includes a pickup roller 2, a feeding roller 3, and a feeding driven roller 4. The pickup roller 2 abuts against the uppermost print sheet 1 stacked on the feeding tray 11 and picks up the print sheet. The feeding roller 3 is configured to feed the print sheet 1 picked up by the pickup roller 2 to the downstream side in the conveying direction. The feeding driven roller 4 is biased and pressed against the feeding roller 3 by an elastic member (for example, a spring) (not shown), and feeds the print sheet 1 by nipping it with the feeding roller 3.

Figure 4A:
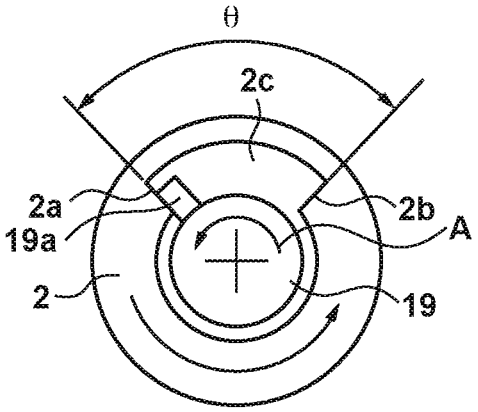
FIGS. 4A and 4B are explanatory views of a pickup roller.
Figure 4B:
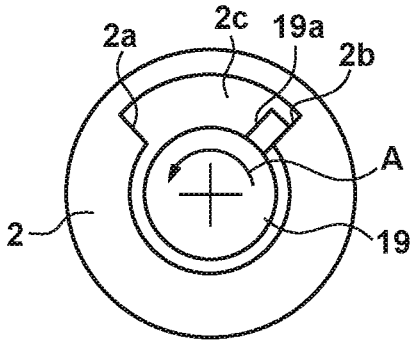

FIGS. 4A and 4B are views for explaining the arrangement of the pickup roller 2. The pickup roller 2 is provided with a drive shaft 19. The drive shaft 19 transmits the driving force of a feeding motor (to be described later) to the pickup roller 2. When picking up the print sheet 1, the drive shaft 19 and the pickup roller 2 rotate in the direction of an arrow A in FIGS. 4A and 4B. The drive shaft 19 is provided with a projection 19*a*. A concave portion 2*c* in which the projection 19*a* is fitted is formed in the pickup roller 2.

As shown in FIG. 4A, when the projection 19*a* abuts against a first surface 2*a* of the concave portion 2*c* of the pickup roller 2, the driving of the drive shaft 19 is transmitted to the pickup roller 2. If the drive shaft 19 is driven, the pickup roller 2 is also rotated. On the other hand, as shown in FIG. 4B, when the projection 19*a* abuts against a second surface 2*b* of the concave portion 2*c* of the pickup roller 2, the driving of the drive shaft 19 is not transmitted to the pickup roller 2. Even if the drive shaft 19 is driven, the pickup roller 2 is not rotated. Even in a case in which the projection 19*a* abuts against neither the first surface 2*a* nor the second surface 2*b* and is located between the first surface 2*a* and the second surface 2*b*, even if the drive shaft 19 is driven, the pickup roller 2 is not rotated. This mechanism makes it possible to ensure a predetermined interval between the print sheets 1 when continuously feeding the plurality of print sheets 1, as will be described later.

Referring back to FIG. 1, the conveying mechanism includes a conveying roller 5 and a pinch roller 6. These rollers form a pair of rollers that nips and conveys the print sheet 1. The conveying roller 5 conveys the print sheet 1 fed by the feeding roller 3 and the feeding driven roller 4 to a position facing the printhead 7. The pinch roller 6 is biased and pressed against the conveying roller 5 by an elastic member (for example, a spring) (not shown), and conveys the print sheet 1 by nipping it with the conveying roller 5. At the time of printing, for example, a predetermined amount of conveyance of the print sheet 1 by the conveying roller 5 and the pinch roller 6, movement of the carriage 10, and ink discharge by the printhead 7 are alternately repeated, thereby printing an image on the print sheet 1.

Conveying guides 15 that guide the conveyance of the print sheet 1 are provided in the conveyance section from a nip portion (to be referred to as a feeding nip portion) formed by the feeding roller 3 and the feeding driven roller 4 to a nip portion (to be referred to as a conveying nip portion) formed by the conveying roller 5 and the pinch roller 6.

The discharging mechanism includes a discharging roller 9 and spurs 12 and 13. The discharging roller 9 discharges the print sheet 1 printed by the printhead 7 to the outside of the apparatus. The spurs 12 and 13 rotate in contact with the printed surface of the print sheet 1 printed by the printhead 7. The spur 13 on the downstream side is biased and pressed against the discharging roller 9 by an elastic member (for example, a spring) (not shown). The spur 12 on the upstream side is arranged on the downstream side of the printhead 7. No discharging roller 9 is arranged at a position facing the spur 12. The spur 12 suppresses floating of the print sheet 1 and is called a pressing spur.

The printing apparatus 100 includes a sheet detection sensor 16. The sheet detection sensor 16 is a sensor configured to detect the leading edge and the trailing edge of the print sheet 1, and is formed from, for example, an optical sensor. The sheet detection sensor 16 is provided on the downstream side of the feeding roller 3 in the conveying direction. A sheet pressing lever 17 is a lever configured to press the trailing edge portion of the preceding print sheet 1 (also called a preceding printing medium or preceding sheet) and overlay the leading edge portion of the succeeding print sheet 1 (also called a succeeding printing medium or succeeding sheet). Note that the leading edge portion and the trailing edge portion of the print sheet 1 mean the downstream side end and the upstream side end in the conveying direction, respectively. The sheet pressing lever 17 is biased by an elastic member (for example, a spring) (not shown) counterclockwise in FIG. 1 about a rotating shaft 17*b*.

Figure 5:
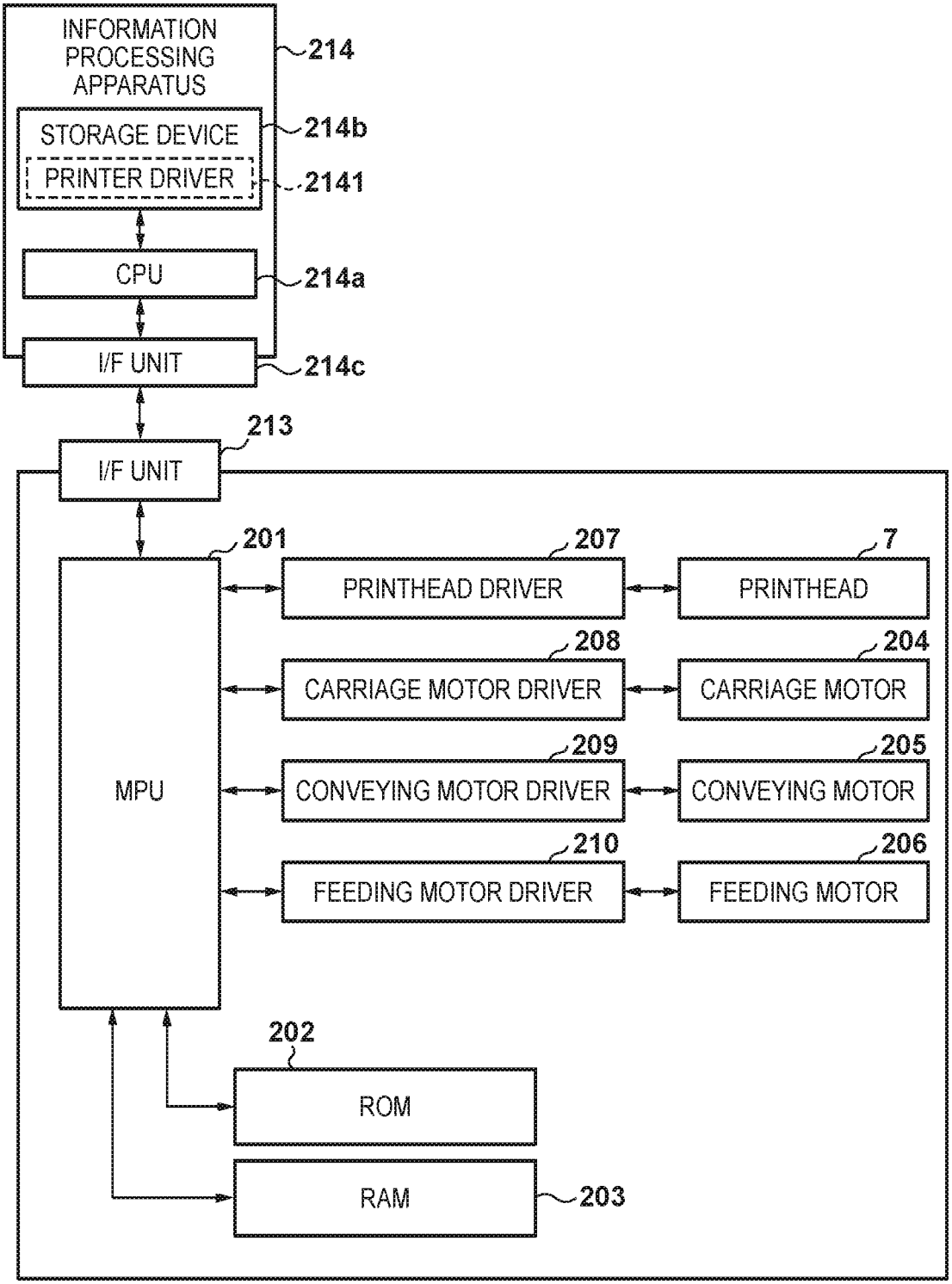
FIG. 5 is a block diagram showing an example of the arrangement of a printing system according to an embodiment of the present invention.

An example of the arrangement of a printing system including the control unit of the printing apparatus 100 and an information processing apparatus 214 capable of transmitting print data to the printing apparatus 100 will be described next with reference to FIG. 5.

The printing apparatus 100 includes an MPU 201. The MPU 201 can control the operation of each component of the printing apparatus 100 and also performs data processing and the like. The MPU 201 can execute conveyance control of the print sheet 1 such that the trailing edge portion of the preceding sheet and the leading edge portion of the succeeding sheet overlap, as will be described later. A ROM 202 stores data and programs to be executed by the MPU 201. A RAM 203 is a RAM that temporarily stores data processed by the MPU 201 or print data received from the information processing apparatus 214. Note that other storage devices can be used in place of the ROM 202 and the RAM 203.

A printhead driver 207 drives the printhead 7. A carriage motor driver 208 drives a carriage motor 204 that is the driving source of a driving mechanism for moving the carriage 10. A conveying motor 205 is the driving source of a driving mechanism for the conveying roller 5 and the discharging roller 9. The conveying motor 205 is driven by a conveying motor driver 209.

A feeding motor 206 is the driving source of a driving mechanism for the pickup roller 2 and the feeding roller 3. The feeding motor 206 is driven by a feeding motor driver 210.

The MPU 201 controls the printing operation (ink discharge and movement of the printhead 7) of the printhead 7 via the printhead driver 207 and the carriage motor driver 208. The MPU 201 also executes conveyance control of the print sheet 1 via the conveying motor driver 209 and the feeding motor driver 210.

The information processing apparatus 214 is, for example, a personal computer or a portable terminal (for example, a smartphone or tablet terminal) and functions as the host computer of the printing apparatus 100. The information processing apparatus 214 includes a CPU 214*a*, a storage device 214*b*, and an I/F unit (interface unit) 214*c*. The CPU 214*a* executes a program stored in the storage device 214*b*. The storage device 214*b* is a RAM, a ROM, or a hard disk, and stores programs to be executed by the CPU 214*a* and various kinds of data. The storage device 214*b* stores a printer driver 2141 configured to control the printing apparatus 100. The information processing apparatus 214 can generate print data by executing the printer driver 2141. The information processing apparatus 214 and the printing apparatus 100 can transmit/receive data via the I/F unit 214*c* and an I/F unit 213.

<Example of Overlap Continuous Feeding>

The overlap continuous feeding operation will time-serially be described with reference to FIGS. 1 to 3. When print data is transmitted from the information processing apparatus 214 via the I/F unit 213, the print data is processed by the MPU 201 and then rasterized on the RAM 203. The MPU 201 starts a printing operation based on the rasterized data.

A description will be made with reference to the state ST1 shown in FIG. 1. First, the feeding motor 206 is driven by the feeding motor driver 210. Accordingly, the pickup roller 2 rotates. In this stage, the feeding motor 206 is driven at a relatively low rotational speed. Here, the pickup roller 2 rotates at, for example, 7.6 inches/sec.

When the pickup roller 2 rotates, an uppermost print sheet (preceding sheet 1-A) stacked on the feeding tray 11 is picked up. The preceding sheet 1-A picked up by the pickup roller 2 is conveyed by the feeding roller 3 that is rotating in the same direction as the pickup roller 2. The feeding roller 3 is also driven by the feeding motor 206. This embodiment will be explained using an arrangement including the pickup roller 2 and the feeding roller 3. However, the arrangement may include only the feeding roller configured to feed a print sheet stacked on the stacking unit.

When the sheet detection sensor 16 provided on the downstream side of the feeding roller 3 detects the leading edge of the preceding sheet 1-A, the feeding motor 206 is driven at a relatively high rotational speed. Here, the pickup roller 2 and the feeding roller 3 rotate at, for example, 20 inches/sec.

A description will be made with reference to a state ST2 shown in FIG. 1. When the feeding roller 3 is continuously rotated, the leading edge of the preceding sheet 1-A rotates the sheet pressing lever 17 clockwise about the rotating shaft 17*b* against the biasing force of the spring. When the feeding roller 3 is further continuously rotated, the leading edge of the preceding sheet 1-A abuts against the conveying nip portion formed by the conveying roller 5 and the pinch roller 6. At this time, the conveying roller 5 stops (roller 5 is at rest). If the feeding roller 3 is rotated by a predetermined amount even after the leading edge of the preceding sheet 1-A abuts against the conveying nip portion, alignment is performed in a state in which the leading edge of the preceding sheet 1-A abuts against the conveying nip portion, and a skew is corrected.

A description will be made with reference to a state ST3 shown in FIG. 1. When the skew correction operation of the preceding sheet 1-A ends, the conveying motor 205 is driven, and the conveying roller 5 thus starts rotating. The conveying roller 5 conveys the sheet at, for example, 15 inches/sec. The preceding sheet 1-A is aligned up to a position facing the printhead 7. This position is the position to start printing by the printhead 7 and is sometimes called an aligning position. After this alignment, ink is discharged from the printhead 7 based on the print data, thereby performing the printing operation.

Note that the aligning operation is performed by abutting the leading edge of the print sheet 1 against the conveying nip portion to temporarily locate the start at the position of the conveying roller 5 and then controlling the rotation amount of the conveying roller 5 using the position of the conveying roller 5 as a reference.

The printing apparatus 100 according to this embodiment is a serial type printing apparatus with the printhead 7 mounted on the carriage 10. The printing operation for the print sheet 1 is performed by repeating a conveying operation and an image forming operation. The conveying operation is an operation of causing the conveying roller 5 to perform intermittent conveyance of a print sheet by a predetermined amount. The image forming operation is an operation of discharging ink from the printhead 7 while moving the carriage 10 on which the printhead 7 is mounted when the conveying roller 5 stops. The image forming operation is sometimes called print scan, and the unit of the range of printing in one print scan is sometimes called a "row".

When the preceding sheet 1-A is aligned, the feeding motor 206 is switched to low-speed driving again. That is, the pickup roller 2 and the feeding roller 3 rotate at 7.6 inches/sec. When the conveying roller 5 intermittently conveys the print sheet 1 by a predetermined amount, the feeding roller 3 is also intermittently driven by the feeding motor 206. That is, if the conveying roller 5 rotates, the feeding roller 3 also rotates. If the conveying roller 5 stops, the feeding roller 3 also stops. The rotational speed of the feeding roller 3 is lower than that of the conveying roller 5. For this reason, the print sheet 1 is stretched between the conveying roller 5 and the feeding roller 3. In addition, the feeding roller 3 is dragged by the print sheet 1 conveyed by the conveying roller 5.

When the feeding motor 206 is intermittently driven, the drive shaft 19 also rotates. However, the rotational speed of the pickup roller 2 is lower than that of the conveying roller 5, as described above. For this reason, the pickup roller 2 is dragged by the print sheet 1 conveyed by the conveying roller 5. Hence, the pickup roller 2 rotates ahead of the drive shaft 19. More specifically, the projection 19*a* of the drive shaft 19 is apart from the first surface 2*a* and is in contact with the second surface 2*b*. Hence, even if the trailing edge of the preceding sheet 1-A passes through the pickup roller 2, the second print sheet (succeeding sheet 1-B) is not immediately picked up. If the preceding sheet 1-A passes through the feeding nip portion, and the drive shaft 19 is driven for a predetermined time, the projection 19*a* abuts against the first surface 2*a*. Accordingly, the rotation of the drive shaft 19 is transmitted to the pickup roller 2, and the pickup roller 2 starts rotating. A time lag to pickup of the succeeding sheet 1-B is thus generated.

A description will be made with reference to a state ST4 shown in FIG. 2. The state ST4 represents a state in which the pickup roller 2 starts rotating and picks up the succeeding sheet 1-B. To more correctly detect an end of the print sheet 1 by the sheet detection sensor 16, the continuous print sheets 1 need to have a predetermined interval or more between them because of a factor such as the responsiveness of the sensor. As already described, in this embodiment, a time lag to pickup of the succeeding sheet 1-B is generated by the arrangement of the drive shaft 19 and the pickup roller 2, thereby ensuring the interval.

That is, to ensure a predetermined time interval from detection of the trailing edge of the preceding sheet 1-A by the sheet detection sensor 16 to detection of the leading edge of the succeeding sheet 1-B, the trailing edge portion of the succeeding sheet 1-B and the leading edge portion of the preceding sheet 1-A are spaced apart by a predetermined distance. For this purpose, the concave portion 2*c* of the pickup roller 2 is set to, for example, about 70°.

A description will be made with reference to a state ST5 shown in FIG. 2. The succeeding sheet 1-B picked up by the pickup roller 2 is conveyed by the feeding roller 3. At this time, the preceding sheet 1-A is undergoing the image forming operation by the printhead 7 based on the print data. When the leading edge of the succeeding sheet 1-B is detected by the sheet detection sensor 16, the feeding motor 206 is switched to high-speed driving again. That is, the pickup roller 2 and the feeding roller 3 rotate at 20 inches/sec.

A description will be made with reference to a state ST6 shown in FIG. 2. The trailing edge portion of the preceding sheet 1-A is pressed downward by the sheet pressing lever 17, as indicated by the state ST5 in FIG. 2. The succeeding sheet 1-B is moved at a higher speed relative to the speed of the movement of the preceding sheet 1-A to the downstream side by the printing operation. This can form a state in which the leading edge portion of the succeeding sheet 1-B overlaps the trailing edge portion of the preceding sheet 1-A (overlap state forming operation: the state ST6 in FIG. 2). The preceding sheet 1-A is undergoing the printing operation based on the print data and is therefore intermittently conveyed by the conveying roller 5. On the other hand, the succeeding sheet 1-B can catch up with the preceding sheet 1-A by rotating the feeding roller 3 continuously at 20 inches/sec after the detection of the leading edge by the sheet detection sensor 16.

A description will be made with reference to a state ST7 shown in FIG. 3. After the overlap state in which the leading edge portion of the succeeding sheet 1-B overlaps the trailing edge portion of the preceding sheet 1-A is formed, the succeeding sheet 1-B is conveyed by the feeding roller 3 until its leading edge stops at a predetermined position (determination position) on the upstream side of the conveying nip portion, and stands by.

The position of the leading edge of the succeeding sheet 1-B is calculated from the rotation amount of the feeding roller 3 after the leading edge of the succeeding sheet 1-B is detected by the sheet detection sensor 16, and controlled based on the calculation result. At this time, the preceding sheet 1-A is undergoing the image forming operation by the printhead 7 based on the print data.

A description will be made with reference to a state ST8 shown in FIG. 3. When the conveying roller 5 stops to perform the image forming operation for the preceding sheet 1-A (here, during the rest for the image forming operation of the last row), the feeding roller 3 is driven. The leading edge of the succeeding sheet 1-B is thus abutted against the conveying nip portion, and the skew correction operation of the succeeding sheet 1-B is performed.

A description will be made with reference to a state ST9 shown in FIG. 3. When the image forming operation for the preceding sheet 1-A ends, the conveying roller 5 is rotated by a predetermined amount, thereby aligning the succeeding sheet 1-B while maintaining the state in which the succeeding sheet 1-B overlaps the preceding sheet 1-A. The printing operation for the succeeding sheet 1-B starts based on the print data. When the succeeding sheet 1-B is intermittently conveyed for the printing operation, the preceding sheet 1-A is also intermittently conveyed. After a while, the preceding sheet 1-A is discharged by the discharging roller 9 to the outside of the printing apparatus.

When the succeeding sheet 1-B is aligned, the feeding motor 206 is switched to low-speed driving again. That is, the pickup roller 2 and the feeding roller 3 rotate at 7.6 inches/sec. If print data still exists after the succeeding sheet 1-B, the process returns to the state ST4 in FIG. 2 to perform the pickup operation of the third print sheet.

In this way, the printing operation can continuously be performed for a plurality of print sheets 1 while performing overlap continuous feeding.

<Execution Timing of Skew Correction Operation>

In a case in which the skew correction operation of the succeeding sheet 1-B is performed in a state in which the trailing edge of the preceding sheet 1-A is located on the upstream side of the conveying nip portion, when the conveying roller 5 is driven, the preceding sheet 1-A and the succeeding sheet 1-B are caught in the conveying nip portion and conveyed. That is, overlap continuous feeding starts. The length from the trailing edge of the preceding sheet 1-A to the conveying nip portion is the overlap amount in overlap continuous feeding when performing the skew correction operation of the succeeding sheet 1-B.

Hence, the execution timing of the skew correction operation of the succeeding sheet 1-B is an important timing in controlling the overlap continuous feeding and the overlap amount. For example, it is necessary to avoid the succeeding sheet 1-B from overlapping the range of image formation on the preceding sheet 1-A. In addition, a large overlap amount is advantageous from the viewpoint of throughput.

In this embodiment, the execution timing of the skew correction operation for the succeeding sheet 1-B can be set based on the positions of the preceding sheet 1-A and the succeeding sheet 1-B when a predetermined condition is met. The predetermined condition is the condition of the position of the preceding sheet 1-A. More specifically, the condition is that the preceding sheet 1-A reaches a position at which a predetermined print range remains as the print range on the preceding sheet 1-A by the printing unit.

This makes it possible to ensure a larger overlap amount while smoothly performing image formation on the preceding sheet 1-A. The printing apparatus 100 according to this embodiment is a serial type printing apparatus. Hence, the remaining print range on the preceding sheet 1-A is defined using the remaining print scan count (the number of rows) as a reference, and the skew correction operation is executed when the conveying roller 5 and the pinch roller 6 stop to cause the printhead 7 to print the row immediately before the last row on the preceding sheet 1-A. In an example of processing to be described below, when the remaining print scan count is 1 (final print scan/last row), the execution timing of the skew correction operation of the succeeding sheet 1-B is set.

<Example of Processing>

Figure 6A:
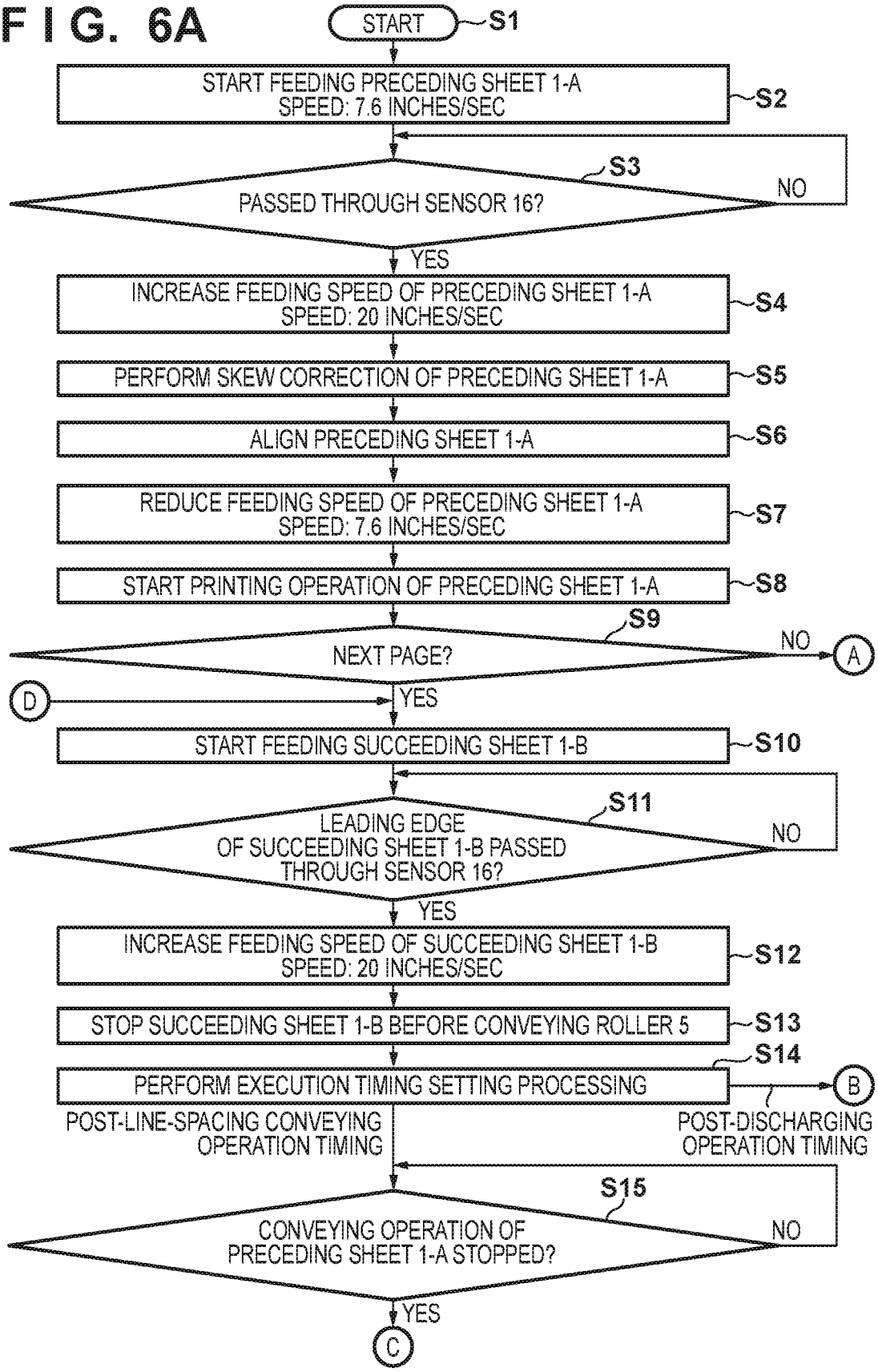
FIGS. 6A and 6B are flowcharts showing an example of processing executed by the control unit of the printing apparatus shown in FIG. 1.
Figure 6B:
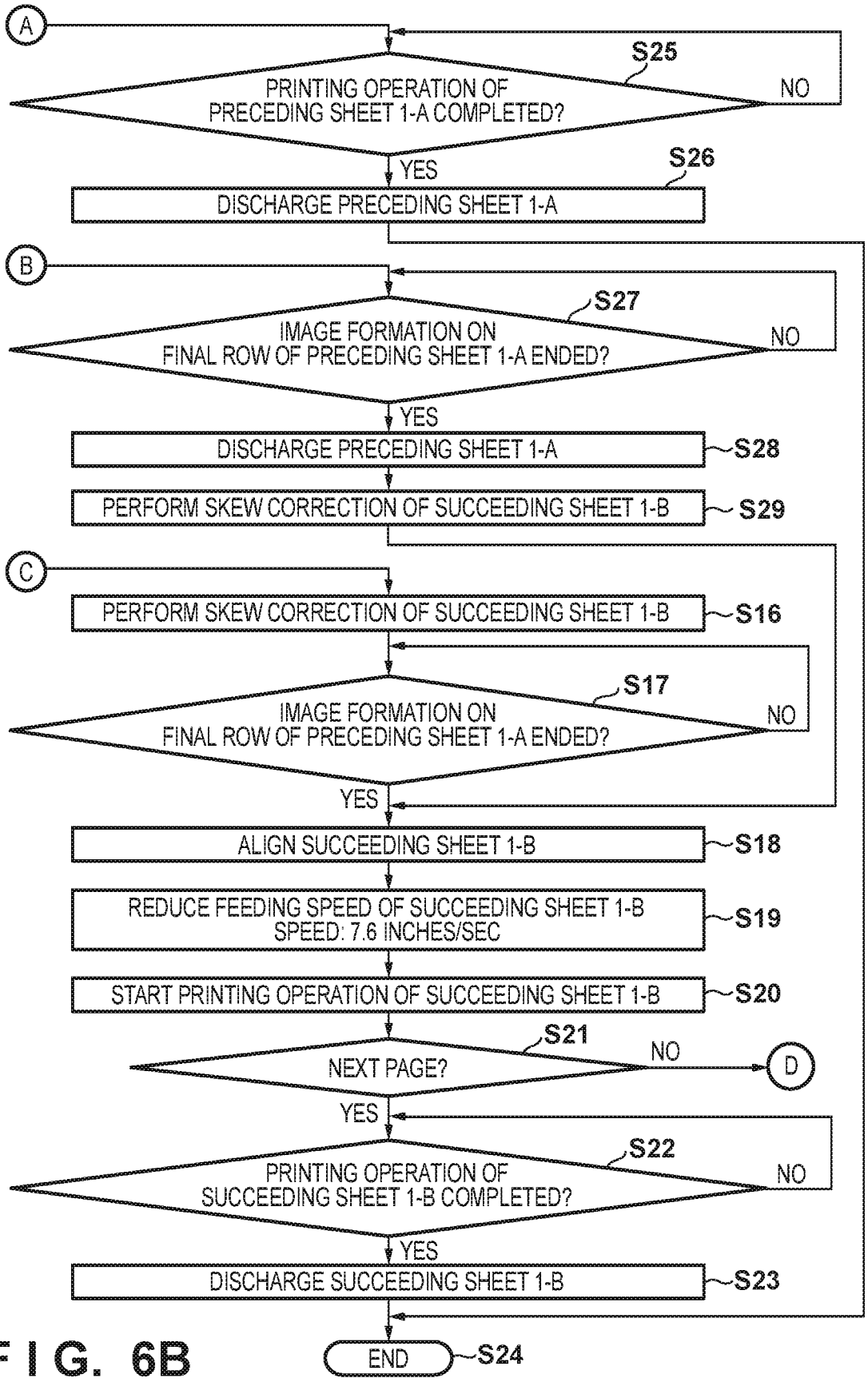

An example of processing of the MPU 201 to execute the above-described overlap continuous feeding will be described next. FIGS. 6A and 6B show flowcharts of overlap continuous feeding processing executed by the MPU 201.

In step S1, when a print start instruction is transmitted from the information processing apparatus 214 via the I/F unit 213, the printing operation starts. In step S2, the feeding operation of the preceding sheet 1-A starts. More specifically, the feeding motor 206 is driven at a low speed. The pickup roller 2 rotates at 7.6 inches/sec. The pickup roller 2 picks up the preceding sheet 1-A, and the feeding roller 3 feeds the preceding sheet 1-A toward the printhead 7.

In step S3, the sheet detection sensor 16 detects the leading edge of the preceding sheet 1-A. When the sheet detection sensor 16 detects the leading edge of the preceding sheet 1-A, the feeding motor 206 is switched to high-speed driving in step S4. That is, the pickup roller 2 and the feeding roller 3 rotate at 20 inches/sec. The rotation amount of the feeding roller 3 after the detection of the leading edge of the preceding sheet 1-A by the sheet detection sensor 16 is controlled, thereby abutting the leading edge of the preceding sheet 1-A against the conveying nip portion and performing the skew correction operation of the preceding sheet 1-A in step S5.

In step S6, the preceding sheet 1-A is aligned based on print data. That is, by controlling the rotation amount of the conveying roller 5, the preceding sheet 1-A is conveyed to a print start position using, as the reference, the position of the conveying roller 5 based on the print data. In step S7, the feeding motor 206 is switched to low-speed driving. In step S8, ink is discharged from the printhead 7 to the preceding sheet 1-A, thereby starting the printing operation.

More specifically, the conveying operation of intermittently conveying the preceding sheet 1-A by the conveying roller 5 and the image forming operation (ink discharge operation) of moving the carriage 10 and discharging ink from the printhead 7 are repeated, thereby performing the printing operation for the preceding sheet 1-A. The feeding motor 206 is intermittently driven at a low speed in synchronism with the operation of intermittently conveying the preceding sheet 1-A by the conveying roller 5. That is, the pickup roller 2 and the feeding roller 3 intermittently rotate at 7.6 inches/sec.

In step S9, it is determined whether the print data of the next page exists. If the print data of the next page does not exist, the process advances to step S25. If the printing operation for the preceding sheet 1-A ends in step S25, the preceding sheet 1-A is discharged, and the printing operation ends in step S26.

If the print data of the next page exists, the feeding operation of the succeeding sheet 1-B starts in step S10. More specifically, the pickup roller 2 picks up the succeeding sheet 1-B, and the feeding roller 3 feeds the succeeding sheet 1-B toward the printhead 7. The pickup roller 2 rotates at 7.6 inches/sec. Since the concave portion 2*c* of the pickup roller 2 is provided large relative to the projection 19*a* of the drive shaft 19, as described above, the succeeding sheet 1-B is conveyed while keeping a predetermined interval to the trailing edge of the preceding sheet 1-A.

In step S11, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S12. That is, the pickup roller 2 and the feeding roller 3 rotate at 20 inches/sec. The rotation amount of the feeding roller 3 after the detection of the leading edge of the succeeding sheet 1-B by the sheet detection sensor 16 is controlled, thereby conveying the succeeding sheet 1-B such that the leading edge of the succeeding sheet 1-B comes to a predetermined position (determination position) spaced apart from the conveying nip portion to the upstream side by a predetermined amount in step S13. The preceding sheet 1-A is intermittently conveyed based on the print data. By continuously drive the feeding motor 206 at a high speed, an overlap state in which the leading edge portion of the succeeding sheet 1-B overlaps the trailing edge portion of the preceding sheet 1-A is formed.

In step S14, the execution timing to execute the skew correction operation of the succeeding sheet 1-B is set. In this embodiment, there are two execution timings. One is a timing (sometimes called post-discharging operation timing) after the conveying operation of the preceding sheet 1-A is performed until the trailing edge of the preceding sheet 1-A passes through the conveying nip portion. The remaining one is a timing (sometimes called post-line-spacing conveying operation timing) after the conveying operation of the preceding sheet 1-A is performed up to the position of the image forming operation (final print scan) of the last row. The post-line-spacing conveying operation timing includes a case in which the trailing edge of the preceding sheet 1-A has already passed through the conveying nip portion (overlap continuous feeding is not performed) and a case in which the trailing edge of the preceding sheet 1-A is located on the upstream side of the conveying nip portion (overlap continuous feeding is performed). Details of the setting will be described later.

If the post-discharging operation timing is set as the result of the setting of step S14, the process advances to step S27. If the post-line-spacing conveying operation timing is set, the process advances to step S15.

In step S15, it is determined whether the conveying operation of the preceding sheet 1-A stops. If the conveying operation stops, the process advances to step S16. If the conveying operation does not stop, the process waits until it stops. In step S16, the leading edge of the succeeding sheet 1-B is abutted against the conveying nip portion, and the skew correction operation of the succeeding sheet 1-B is performed. In the setting of step S14, if the trailing edge of the preceding sheet 1-A is located on the upstream side of the conveying nip portion, the skew correction operation of the succeeding sheet 1-B is executed while maintaining the overlap state of the preceding sheet 1-A and the succeeding sheet 1-B.

Note that in this embodiment, driving of the feeding roller 3 is assumed to start for skew correction of the succeeding sheet 1-B after stopping of the conveying operation. However, it is only necessary to rest the conveying roller 5 when abutting the succeeding sheet 1-B against the conveying nip portion. Hence, driving of the feeding roller 3 may start for skew correction of the succeeding sheet 1-B a predetermined time before the stopping of the conveying operation.

If it is determined in step S17 that the image forming operation of the last row on the preceding sheet 1-A ends, the succeeding sheet 1-B is aligned. At this time, there are a case in which the preceding sheet 1-A and the succeeding sheet 1-B are conveyed without overlapping and a case in which they are conveyed while making the overlap portion between the trailing edge portion of the preceding sheet 1-A and the leading edge portion of the succeeding sheet 1-B caught in the conveying nip portion.

If the image forming operation of the last row on the preceding sheet 1-A ends in step S27, the discharging operation of the preceding sheet 1-A is performed in step S28. The discharging operation of the preceding sheet 1-A is performed until the trailing edge of the preceding sheet 1-A at least passes through the conveying nip portion. In this embodiment, the preceding sheet 1-A is stopped before its trailing edge passes through the printhead 7. As a detailed example, the discharging operation is performed until the trailing edge of the preceding sheet 1-A comes to a position spaced apart from the conveying nip portion to the downstream side by 5 mm in the sheet conveying direction.

Since the feeding roller 3 is not driven during this time, the succeeding sheet 1-B stops while keeping its leading edge at the position spaced apart from the conveying nip portion to the upstream side by the predetermined amount. In step S29, the leading edge of the succeeding sheet 1-B is abutted against the conveying nip portion, and the skew correction operation of the succeeding sheet 1-B is performed. In step S18, the succeeding sheet 1-B is aligned.

In step S19, the feeding motor 206 is switched to low-speed driving. In step S20, ink is discharged from the printhead 7 to the succeeding sheet 1-B, thereby starting the printing operation. More specifically, the conveying operation of intermittently conveying the succeeding sheet 1-B by the conveying roller 5 and the image forming operation (ink discharge operation) of moving the carriage 10 and discharging ink from the printhead 7 are repeated, thereby performing the printing operation for the succeeding sheet 1-B. The feeding motor 206 is intermittently driven at a low speed in synchronism with the operation of intermittently conveying the succeeding sheet 1-B by the conveying roller 5. That is, the pickup roller 2 and the feeding roller 3 intermittently rotate at 7.6 inches/sec.

In step S21, it is determined whether the print data of the next page exists. If the print data of the next page exists, the process returns to step S10. In a case in which the print data of the next page does not exist, if the image forming operation for the succeeding sheet 1-B ends in step S22, the discharging operation of the succeeding sheet 1-B is performed in step S23, and the printing operation ends in step S24.

Figure 7:
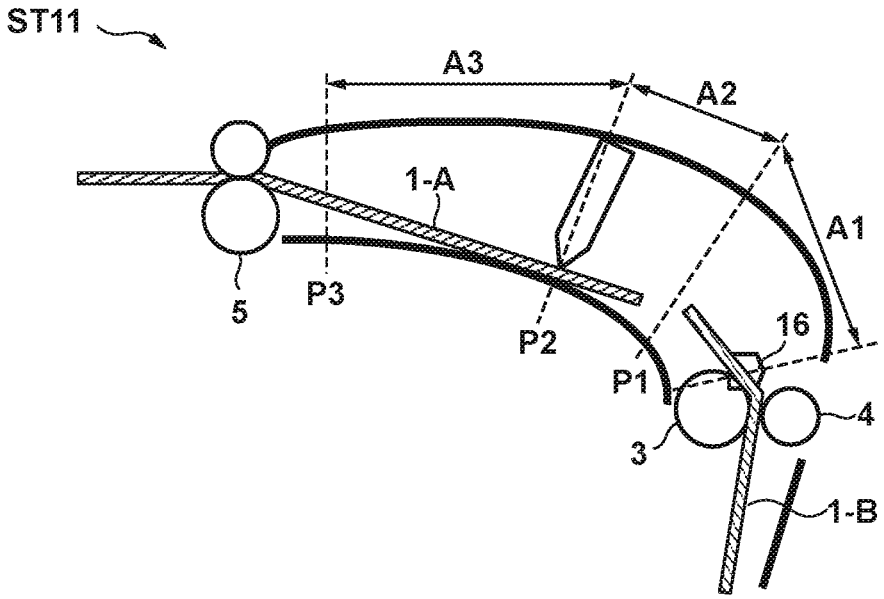
FIG. 7 is a view for explaining an operation of overlaying a succeeding sheet on a preceding sheet.
Figure 7:
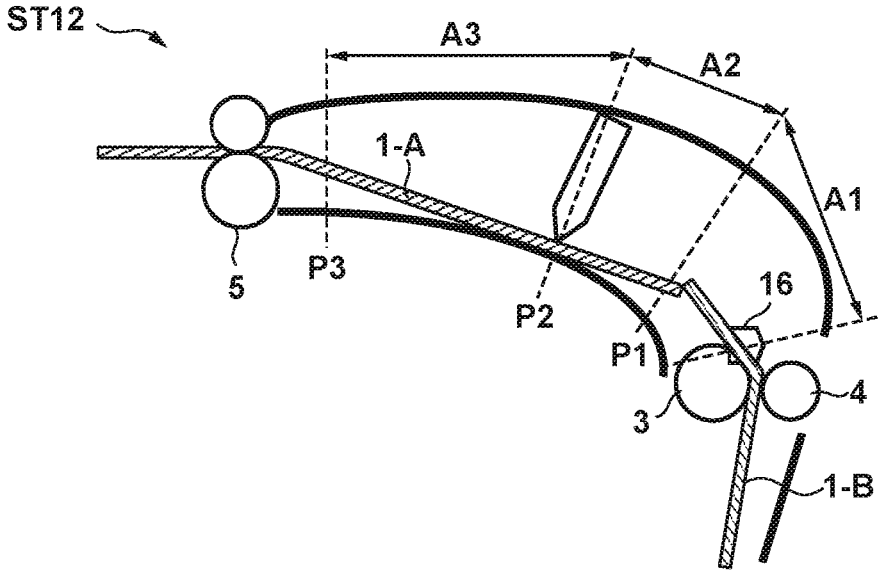
Figure 8:
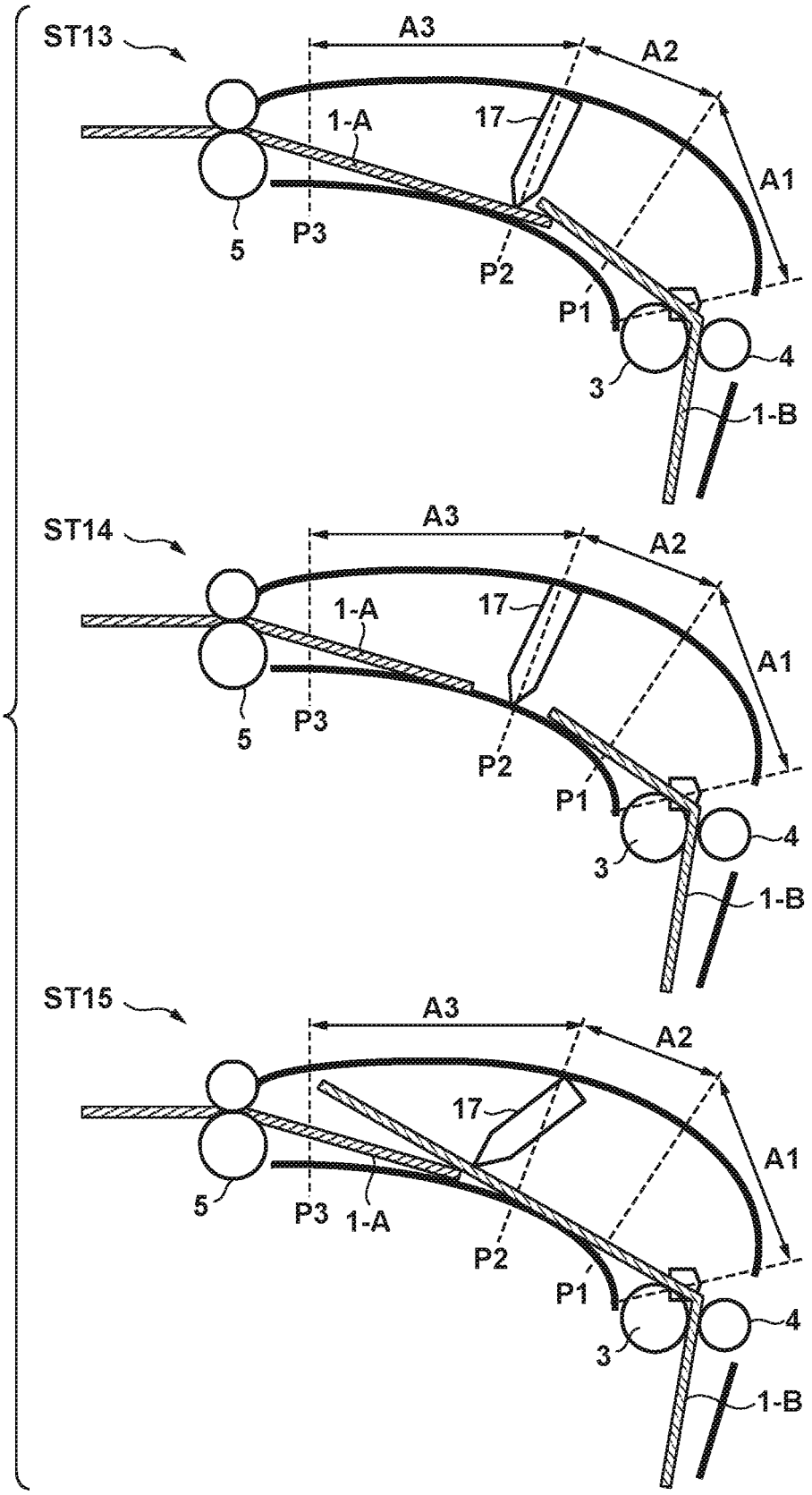
FIG. 8 is a view for explaining an operation of overlaying a succeeding sheet on a preceding sheet.

An operation of forming the overlap state in which the leading edge portion of the succeeding sheet 1-B is overlaid on the trailing edge portion of the preceding sheet 1-A, which has been described concerning steps S12 and S13 of FIG. 6A, will be described next. FIGS. 7 and 8 are views for explaining the operation of overlaying the succeeding sheet 1-B on the preceding sheet 1-A according to this embodiment. FIGS. 7 and 8 are enlarged views of a portion between the feeding nip portion formed by the feeding roller 3 and the feeding driven roller 4 and the conveying nip portion formed by the conveying roller 5 and the pinch roller 6.

The process of conveying the print sheet 1 by the conveying roller 5 and the feeding roller 3 will be described sequentially as three states. A first state in which an operation of making the succeeding sheet 1-B chase the preceding sheet 1-A will be described with reference to states ST11 and ST12 shown in FIG. 7. A second state in which an operation of overlaying the succeeding sheet 1-B on the preceding sheet 1-A will be described with reference to states ST13 and ST14 shown in FIG. 8. A third state in which it is determined whether to perform the skew correction operation of the succeeding sheet 1-B while maintaining the overlap state will be described with reference to a state ST15 shown in FIG. 8.

In the state ST11 of FIG. 7, the succeeding sheet 1-B is conveyed by controlling the feeding roller 3, and the sheet detection sensor 16 detects the leading edge of the succeeding sheet 1-B. The section from the sheet detection sensor 16 to a position P1 where the succeeding sheet 1-B can be overlaid on the preceding sheet 1-A will be defined as a first section A1. In the first section A1, an operation of making the leading edge of the succeeding sheet 1-B chase the trailing edge of the preceding sheet 1-A is performed. The position P1 is decided by the arrangement of the mechanism.

In the first state, there exists a case in which the operation of making the succeeding sheet chase the preceding sheet is stopped in the first section A1. If the leading edge of the succeeding sheet 1-B passes the trailing edge of the preceding sheet 1-A before the position P1, as indicated by the state ST12 shown in FIG. 7, the operation of overlaying the succeeding sheet 1-B on the preceding sheet 1-A is not performed.

In the state ST13 of FIG. 8, the section from the position P1 to a position P2 where the sheet pressing lever 17 is provided will be defined as a second section A2. In the second section A2, the operation of overlaying the succeeding sheet 1-B on the preceding sheet 1-A is performed.

In the second state, there exists a case in which the operation of overlaying the succeeding sheet on the preceding sheet is stopped in the second section A2. If the leading edge of the succeeding sheet 1-B cannot catch up with the trailing edge of the preceding sheet 1-A in the second section A2, as indicated by the state ST14 shown in FIG. 8, the operation of overlaying the succeeding sheet 1-B on the preceding sheet 1-A cannot be performed.

In the state ST15 of FIG. 8, the section from the above-described position P2 to a position P3 will be defined as a third section A3. The position P3 is the position of the leading edge when the succeeding sheet 1-B comes to rest in step S13 of FIG. 6A. Conveyance is performed until the leading edge of the succeeding sheet 1-B reaches the position P3 in a state in which the succeeding sheet 1-B is overlaid on the preceding sheet 1-A. In the third section A3, it is set whether to align the succeeding sheet 1-B by abutting it against the conveying nip portion in the third section A3 while maintaining the overlap state is set. That is, it is set whether to align the succeeding sheet 1-B by executing overlap continuous feeding and performing the skew correction operation or whether to align the succeeding sheet 1-B by canceling the state and performing the skew correction operation without executing overlap continuous feeding.

Figure 9:
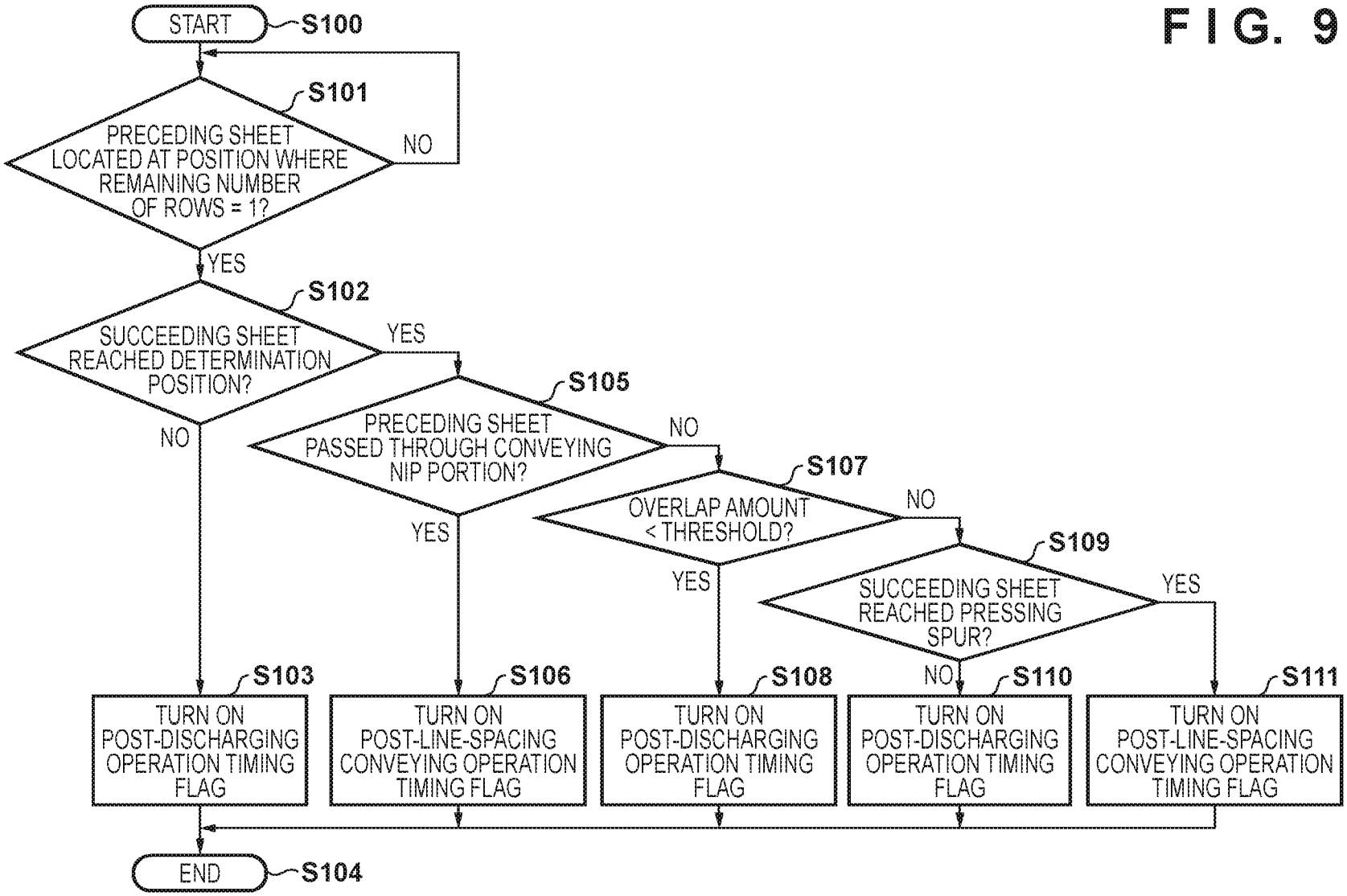
FIG. 9 is a flowchart showing an example of processing executed by the control unit of the printing apparatus shown in FIG. 1.

FIG. 9 is a flowchart showing an example of setting processing of step S14. As the execution timing of the skew correction operation of the succeeding sheet 1-B, one of the post-discharging operation timing and the post-line-spacing conveying operation timing is set. The set contents are managed by a flag. A flag for the former timing will be referred to as a post-discharging operation timing flag, and a flag for the latter timing will be referred to as a post-line-spacing conveying operation timing flag.

In step S100, the processing starts. In step S101, it is determined whether the condition to set the execution timing of the skew correction operation for the succeeding sheet 1-B is met. In this example, it is determined whether the remaining print range is the last row or not. For example, if the preceding sheet 1-A is in a state during the period from the start of printing of the row immediately before the last row to the completion of conveyance of the preceding sheet 1-A to the print position of the last row, it is determined that the condition is met. If the condition is met, the process advances to step S102. If the condition is not met, the printing operation of the preceding sheet 1-A is continued.

The nozzle length or the distance between the conveying nip portion and the printhead 7 is known. Hence, the determination of step S101 may be done based on the position of the preceding sheet 1-A with respect to the conveying nip portion.

In steps S102 to S111, the execution timing of the skew correction operation for the succeeding sheet 1-B is set based on the positions of the preceding sheet 1-A and the succeeding sheet 1-B.

In step S102, it is determined whether the leading edge of the succeeding sheet 1-B has reached the determination position (the position P3 in the state ST15 shown in FIG. 8). As a detailed example, the determination position is set to a position spaced apart from the conveying nip portion to the upstream side by 8 mm.

If the leading edge of the succeeding sheet 1-B has not reached the determination position (NO in step S102), there is some question as to whether the leading edge of the succeeding sheet 1-B abuts against the conveying nip portion by the conveyance of a predetermined amount. For this reason, it is determined not to execute overlap continuous feeding, the post-discharging operation timing flag is turned on, and the setting processing ends (step S104). In this case, for example, only the preceding sheet 1-A is conveyed until the trailing edge of the preceding sheet 1-A comes to a position spaced apart from the conveying nip portion to the downstream side by, for example, 5 mm in the sheet conveying direction, and then stopped. Next, only the succeeding sheet 1-B is abutted against the conveying nip portion, and the skew correction operation is performed. After that, conveyance of the succeeding sheet 1-B for alignment and conveyance of the preceding sheet 1-A by the same amount are simultaneously performed.

If the leading edge of the succeeding sheet 1-B has reached the determination position P3 (YES in step S102), it is determined whether the trailing edge of the preceding sheet 1-A has passed through the conveying nip portion (step S105). Upon determining that the trailing edge of the preceding sheet 1-A has passed through the conveying nip portion (YES in step S105), the preceding sheet 1-A and the succeeding sheet 1-B do not overlap. The printing operation of the last row of the preceding sheet 1-A is yet to be performed. Hence, the post-line-spacing conveying operation timing flag is turned on in step S106, and the setting processing ends.

Upon determining that the trailing edge of the preceding sheet 1-A has not passed through the conveying nip portion (NO in step S105), it is determined whether the overlap amount between the trailing edge portion of the preceding sheet 1-A and the leading edge portion of the succeeding sheet 1-B is smaller than a threshold (step S107). In the determination of step S107, it is determined whether the overlap amount when forming the image of the last row on the preceding sheet 1-A is smaller than the threshold or not. The threshold can be set to, for example, 9 mm.

Upon determining that the overlap amount is smaller than the threshold (YES in step S107), it is determined not to execute overlap continuous feeding, the post-discharging operation timing flag is turned on (step S108), and the setting processing ends. That is, after the image forming operation for the preceding sheet 1-A ends, the succeeding sheet 1-B is not conveyed together with the preceding sheet 1-A. More specifically, although the preceding sheet 1-A is conveyed by driving the conveying roller 5, the feeding roller 3 is not driven. Hence, the overlap state is canceled. In addition, only the succeeding sheet 1-B is abutted against the conveying nip portion, and the skew correction operation is performed. After that, conveyance of the succeeding sheet 1-B for alignment and conveyance of the preceding sheet 1-A by the same amount are simultaneously performed.

Upon determining that the overlap amount is equal to or larger than the threshold (NO in step S107), it is determined whether to execute overlap continuous feeding based on the position of the succeeding sheet 1-B when the printhead 7 starts printing on the succeeding sheet 1-B. Here, for example, the position of the succeeding sheet 1-B relative to the pressing spur 12 is used as the reference. That is, it is determined whether the succeeding sheet 1-B reaches the pressing spur 12 when aligning the succeeding sheet 1-B (when the printhead 7 starts printing on the succeeding sheet 1-B) (step S109). Note that the method of calculating the position of the succeeding sheet 1-B will be described later with reference to FIGS. 11 and 12.

Upon determining that the succeeding sheet 1-B does not reach the pressing spur 12 (NO in step S109), it is determined not to execute overlap continuous feeding, the post-discharging operation timing flag is turned on (step S110), and the setting processing ends. Overlap continuous feeding is not executed in consideration of floating of the succeeding sheet 1-B that may occur if the succeeding sheet 1-B has not reached the pressing spur 12. As a result, after the image forming operation for the preceding sheet 1-A ends, the succeeding sheet 1-B is not conveyed together with the preceding sheet 1-A. More specifically, the conveying roller 5 is driven by the conveying motor 205 to convey the preceding sheet 1-A until its trailing edge comes to a position spaced apart from the conveying nip portion to the downstream side (for example, a position spaced apart by 5 mm) in the sheet conveying direction. However, the feeding roller 3 is not driven. Hence, the overlap state is canceled. In addition, only the succeeding sheet 1-B is abutted against the conveying nip portion, and the skew correction operation is performed. After that, conveyance of the succeeding sheet 1-B for alignment and conveyance of the preceding sheet 1-A by the same amount are simultaneously performed.

Upon determining that the succeeding sheet 1-B reaches the pressing spur 12 (YES in step S109), the post-line-spacing conveying operation timing flag is turned on in step S111, and the setting processing ends. That is the succeeding sheet 1-B is abutted against the conveying nip portion in a state in which it overlaps the preceding sheet 1-A. More specifically, driving of the conveying motor 205 is not executed. Only the feeding motor 206 is driven to rotate only the feeding roller 3 in a state in which the conveying roller 5 stops, thereby performing the skew correction operation of the succeeding sheet 1-B. After the skew correction operation, the succeeding sheet 1-B is aligned in a state in which it overlaps the preceding sheet 1-A.

The execution timing of the skew correction operation of the succeeding sheet 1-B can thus be set.

Figure 10:
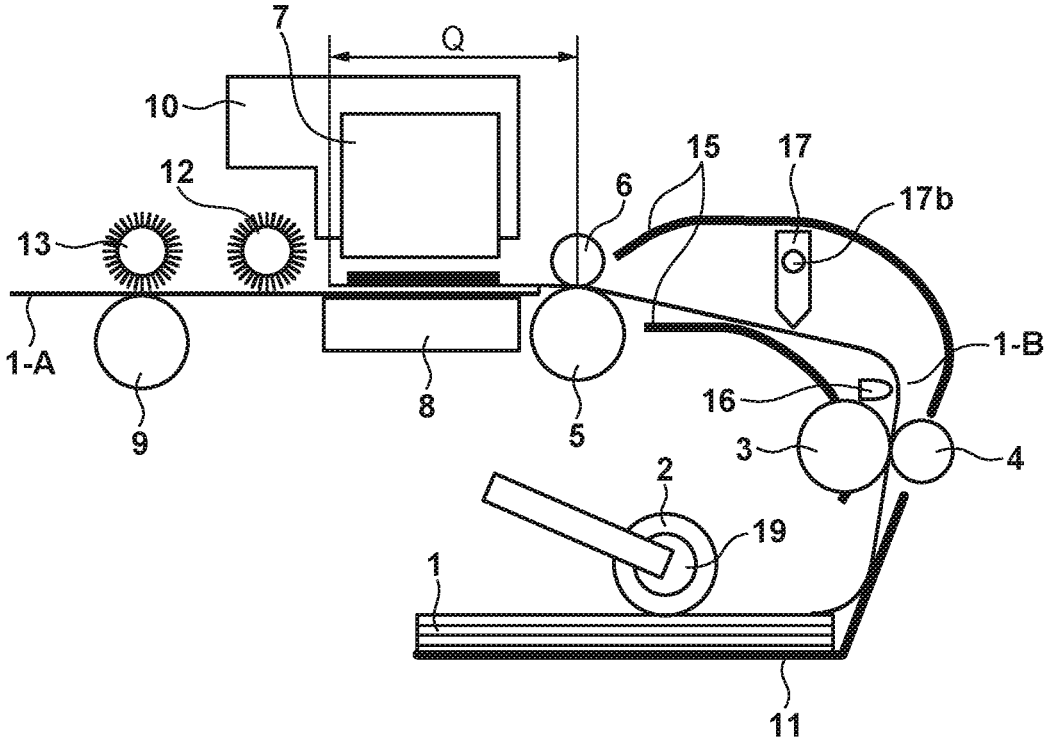
FIG. 10 is an explanatory view of a length Q.
Figure 11:
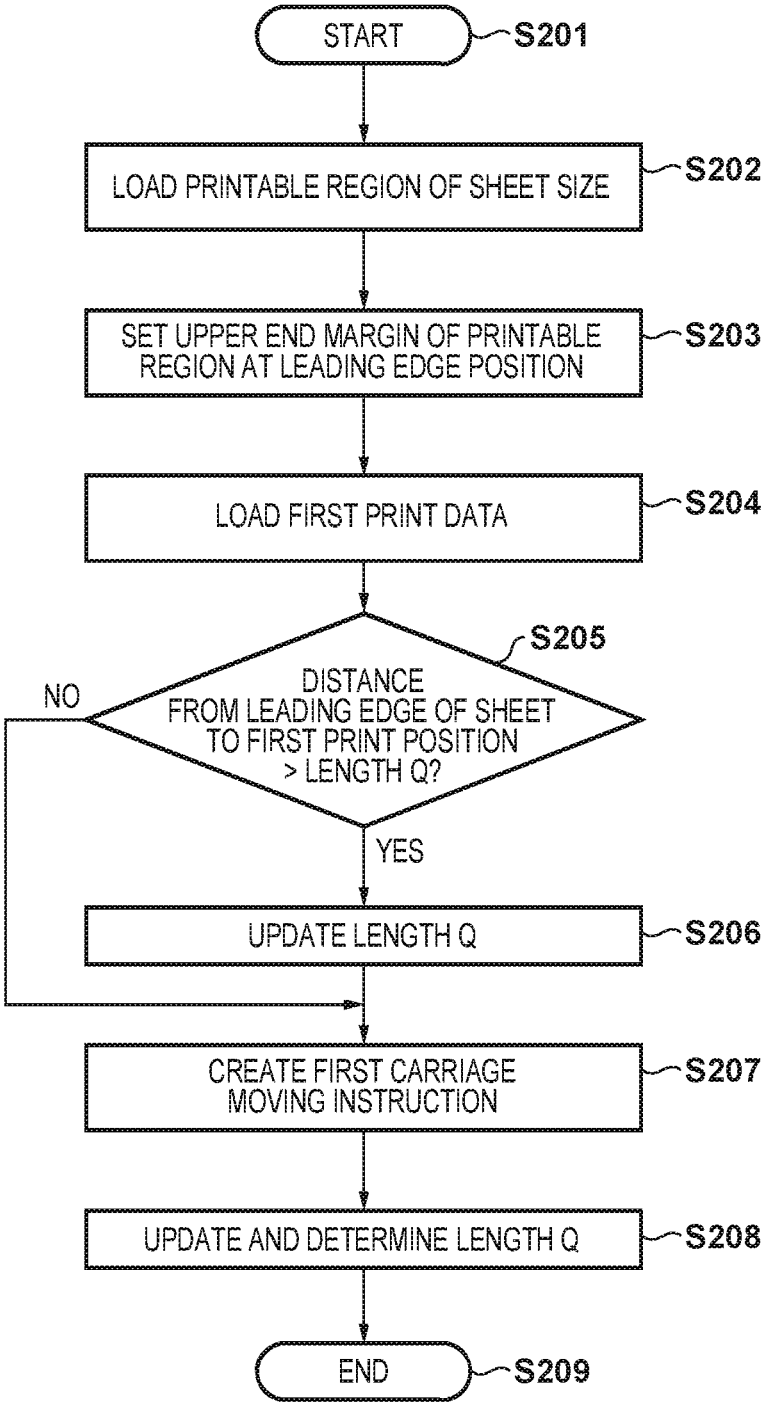
FIG. 11 is a flowchart showing an example of processing of calculating the length Q.

An example of calculation of the position of the succeeding sheet 1-B will be described next with reference to FIGS. 10 and 11. Here, a case in which a length Q from the conveying nip portion to the leading edge of the succeeding sheet 1-B when the printhead 7 starts printing on the succeeding sheet 1-B is calculated will be exemplified, as shown in FIG. 11. The length Q defines the position of the leading edge of the succeeding sheet 1-B. Since the distance from the conveying nip portion to the pressing spur 12 is known as the design, it can be determined whether the succeeding sheet 1-B has reached the pressing spur 12 by comparing the distance with the length Q.

FIG. 11 is a flowchart showing an example of processing of calculating the length Q. In step S201, the processing starts. In step S202, the information of a printable region corresponding to the sheet size of the succeeding sheet 1-B is loaded. The information of the printable region can be stored in, for example, the ROM 202. A printable position on the leading edge, that is, the upper end margin is specified from the information of the printable region. The length Q is temporarily defined by the upper end margin (step S203).

Next, first print data to be printed on the succeeding sheet 1-B is loaded (step S204). The first print data here means first print data that needs ink discharge. That is, a blank is not included. The position of the first print data from the leading edge of the sheet is thus specified. In other words, a non-printing region is specified. Hence, it is determined whether the distance from the leading edge of the succeeding sheet 1-B to the first print data is larger than the previously temporarily set length Q (step S205). If the distance is larger, the process advances to step S206. If the distance is not larger, the process advances to step S207. In step S206, the length Q is updated to the distance from the leading edge of the succeeding sheet 1-B to the first print data.

Next, a first carriage moving instruction is created (step S207). When the carriage moving instruction is created, a nozzle to be used to print the first print data is decided. In step S208, the length Q is updated as needed such that the position of the decided nozzle matches the print start position of the succeeding sheet 1-B, and the length Q is determined (step S208). The determined value of the length Q is saved in, for example, the RAM 203, and the processing ends (step S209).

Note that the step of calculating the leading edge position after the alignment of the succeeding sheet described here is step S9 of the flowchart of the overlap continuous feeding operation shown in FIG. 6A, which can be started immediately after the existence of the print data of the next page is confirmed.

As described above, according to this embodiment, it is unnecessary to determine whether to execute overlap continuous feeding at the start time of feeding of the succeeding sheet 1-B. This is advantageous because, for example, even if the margin amount of the succeeding sheet 1-B is unknown at the start time of feeding of the succeeding sheet 1-B, overlap continuous feeding can be executed when the margin amount is confirmed later. In this case, whether to execute overlap continuous feeding is determined later. For example, the determination is done immediately before the conveyance of the succeeding sheet 1-B by the conveying roller 5. However, since the timing of skew correction is switched in accordance with the determination result, a conveyance error can be avoided.

According to the embodiment, synchronous/asynchronous driving of the feeding motor 206 and the conveying motor 205 when the printhead 7 performs the printing operation on the preceding sheet 1-A is switched. More specifically, before the sheet detection sensor 16 detects the leading edge of the succeeding sheet 1-B, the feeding motor 206 is driven in synchronism with the conveying motor 205. On the other hand, after the leading edge of the succeeding sheet is detected by the sheet detection sensor 16, the feeding motor 206 is continuously driven. By the continuous driving, the chasing operation for overlaying the succeeding sheet 1-B on the preceding sheet 1-A can be performed, and the overlap amount between the preceding and succeeding print sheets 1 in overlap continuous feeding can be adjusted. The overlap amount is set by referring to the print data of the preceding sheet 1-A and the print data of the succeeding sheet 1-B.

Note that in this embodiment, in the stage of feeding, the preceding sheet 1-A and the succeeding sheet 1-B are fed at an interval. However, an arrangement that conveys them in an overlap state from the stage of feeding can also be employed.

In this embodiment, at the time of overlap continuous feeding, the sheets are assumed to overlap such that the succeeding sheet 1-B is located on the side of the printhead 7 with respect to the preceding sheet 1-A. However, the positions may be replaced. That is, the sheets may overlap such that the preceding sheet 1-A is located on the side of the printhead 7 with respect to the succeeding sheet 1-B.

Second Embodiment

Figure 12:
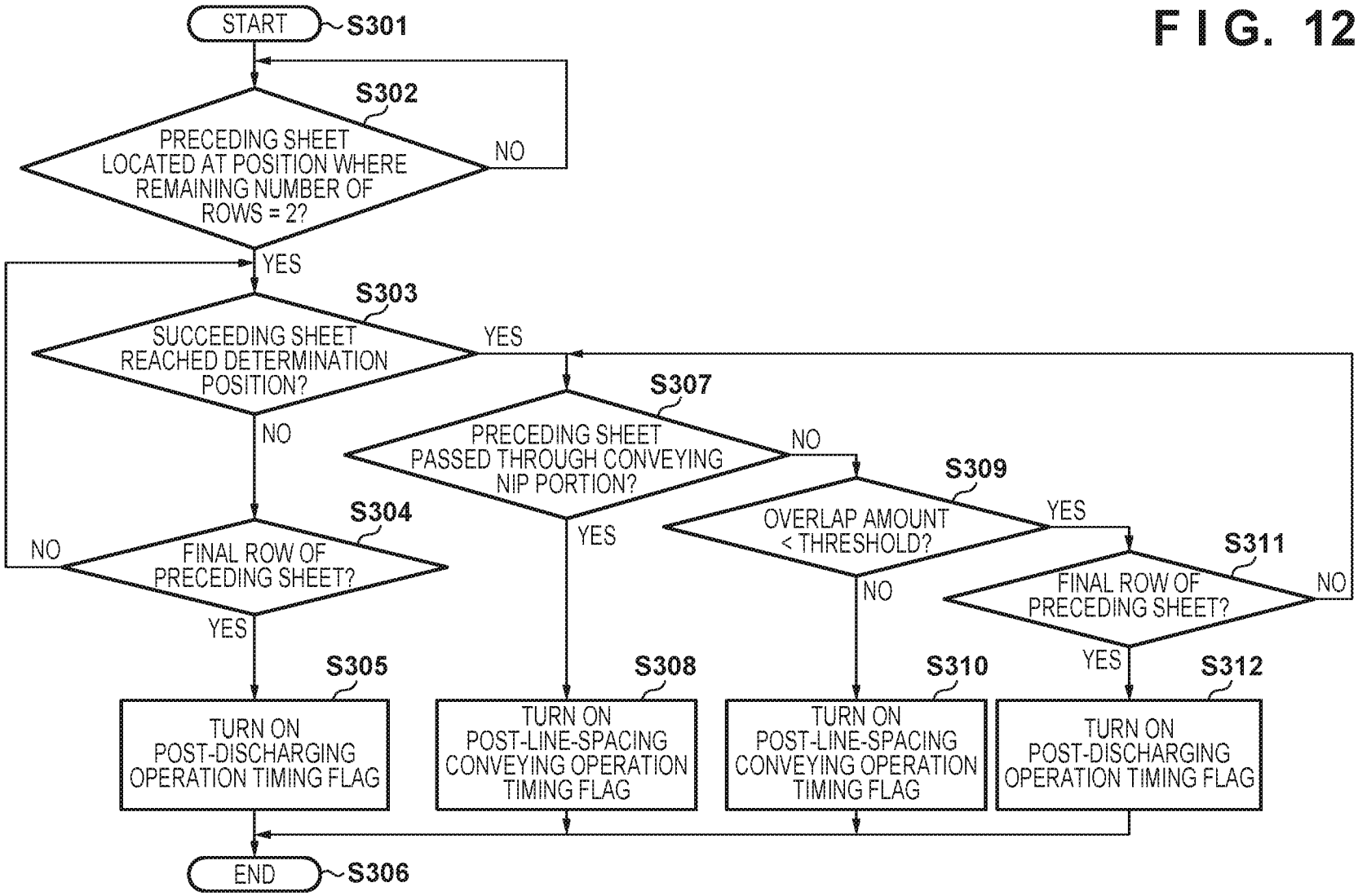
FIG. 12 is a flowchart showing an example of processing executed by the control unit of the printing apparatus shown in FIG. 1.

In the first embodiment, an example in which it is determined in step S101 of FIG. 9 whether the remaining print range is the last row or not has been described. However, the condition of the remaining print range may be set to a plurality of rows. This may make it possible to increase the overlap amount between a preceding sheet 1-A and a succeeding sheet 1-B and improve throughput. FIG. 12 is a flowchart showing another example of setting processing in step S14. FIG. 12 shows an example in which the condition of the remaining print range is set to two rows (two print scan processes remain). The timing of executing the skew correction operation of the succeeding sheet 1-B while maintaining an overlap state includes not only a timing during the image forming operation of the last row but also a timing during the image forming operation of the row immediately before the last row.

In step S301, the processing starts. In step S302, it is determined whether the condition to set the execution timing of the skew correction operation for the succeeding sheet 1-B is met. In this example, it is determined whether the remaining print range includes two rows. For example, if the preceding sheet 1-A is in a state during the period from the start of printing of the second row from the last row to the completion of conveyance of the preceding sheet 1-A to the print position immediately before the last row, it is determined that the condition is met. If the condition is met, the process advances to step S303. If the condition is not met, the printing operation of the preceding sheet 1-A is continued.

The nozzle length or the distance between the conveying nip portion and the printhead 7 is known. Hence, the determination of step S302 may be done based on the position of the preceding sheet 1-A with respect to the conveying nip portion. For example, assume that when the print position of the last row of the preceding sheet 1-A reaches the conveying nip portion, the remaining print range includes two rows. In this case, the determination of step S302 is done by determining whether the print position of the last row of the preceding sheet 1-A (in other words, a position corresponding to the trailing edge portion of the image printed on the last row) has reached the conveying nip portion or not. In this way, whether the preceding sheet 1-A has reached a predetermined position may be determined based on whether a specific print position on the preceding sheet 1-A has reached the conveying nip portion. Position determination of the preceding sheet 1-A may be facilitated by using the conveying nip portion as a reference.

In steps S303 to S312, the execution timing of the skew correction operation for the succeeding sheet 1-B is set based on the positions of the preceding sheet 1-A and the succeeding sheet 1-B.

In step S303, it is determined whether the leading edge of the succeeding sheet 1-B has reached a determination position (a position P3 in a state ST15 shown in FIG. 8). If the leading edge of the succeeding sheet 1-B has not reached the determination position (NO in step S303), it is determined whether the printing operation of the preceding sheet 1-A is performed for the last row (step S304). Upon determining that the printing operation of the preceding sheet 1-A is not performed for the last row (NO in step S304), the printing operation of the preceding sheet 1-A is continued, and the process returns to step S303.

If the printing operation of the preceding sheet 1-A is performed for the last row (YES in step S304), there is some question as to whether the leading edge of the succeeding sheet 1-B abuts against the conveying nip portion by the conveyance of a predetermined amount. For this reason, it is determined not to execute overlap continuous feeding, the post-discharging operation timing flag is turned on (step S305), and the setting processing ends (step S306). In this case, for example, only the preceding sheet 1-A is conveyed until the trailing edge of the preceding sheet 1-A comes to a position spaced apart from the conveying nip portion to the downstream side by, for example, 5 mm in the sheet conveying direction, and then stopped. Next, only the succeeding sheet 1-B is abutted against the conveying nip portion, and the skew correction operation is performed. After that, conveyance of the succeeding sheet 1-B for alignment and conveyance of the preceding sheet 1-A by the same amount are simultaneously performed.

If the leading edge of the succeeding sheet 1-B has reached the determination position (P3 in the state ST15 in FIG. 8) (YES in step S303), it is determined whether the trailing edge of the preceding sheet 1-A has passed through the conveying nip portion (step S307). Upon determining that the trailing edge of the preceding sheet 1-A has passed through the conveying nip portion (YES in step S307), the preceding sheet 1-A and the succeeding sheet 1-B do not overlap. The printing operation of the last row of the preceding sheet 1-A or the row immediately before the last row is yet to be performed. Hence, the post-line-spacing conveying operation timing flag is turned on in step S308, and the setting processing ends.

Upon determining that the trailing edge of the preceding sheet 1-A has not passed through the conveying nip portion (NO in step S307), it is determined whether the overlap amount between the trailing edge portion of the preceding sheet 1-A and the leading edge portion of the succeeding sheet 1-B is smaller than a threshold (step S309). Upon determining that the overlap amount is equal to or larger than the threshold (NO in step S309), the post-line-spacing conveying operation timing flag is turned on, and the setting processing ends. The skew correction operation of the succeeding sheet 1-B is performed during image formation of the row immediately before the last row or during image formation of the last row.

Upon determining that the overlap amount is smaller than the threshold (YES in step S309), it is determined whether the printing operation of the preceding sheet 1-A is performed for the last row (step S311). Upon determining that the printing operation of the preceding sheet 1-A is not performed for the last row (NO in step S311), the printing operation of the preceding sheet 1-A is continued, and the process returns to step S307.

If the printing operation of the preceding sheet 1-A is performed for the last row (YES in step S311), it is determined not to execute overlap continuous feeding, the post-discharging operation timing flag is turned on (step S312), and the setting processing ends (step S306).

As described above, according to this embodiment, the skew correction operation of the succeeding sheet 1-B can be executed from the row immediately before the last row to the last row of the preceding sheet 1-A, and the printing speed can be improved as compared to the first embodiment.

Third Embodiment

If two print sheets 1 are conveyed by a conveying roller 5 in an overlap state by overlap continuous feeding, slipping may occur depending on the type of the print sheet 1, and a conveyance error may occur as compared to a case in which only one print sheet is conveyed. In this embodiment, an example in which an influence on image formation after the overlap portion between a preceding sheet 1-A and a succeeding sheet 1-B starts passing through a conveying nip portion is reduced will be described.

In this embodiment, an example in which an influence on image formation on the succeeding sheet 1-B will be described. Here, not only setting of the execution timing of the skew correction operation of the succeeding sheet 1-B, but also a print mode within the range of a predetermined length from the leading edge of the succeeding sheet 1-B is taken into consideration. An example, in which considering the arrangement mode of print scan as the print mode, the conveyance amount and nozzles to be used in the printing operation of the succeeding sheet 1-B can be changed, will be described.

Figure 13A:
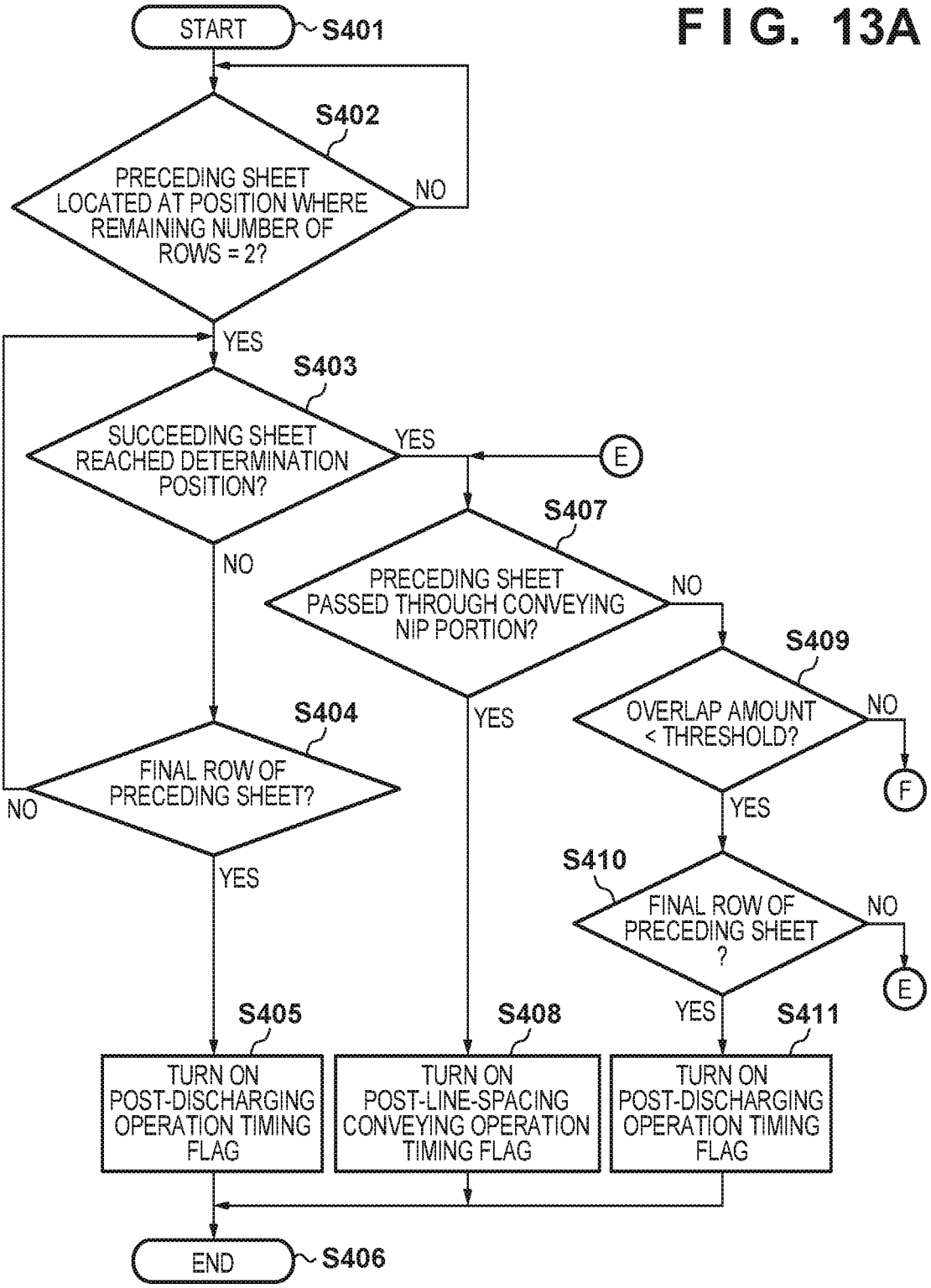
FIGS. 13A and 13B are flowcharts showing an example of processing executed by the control unit of the printing apparatus shown in FIG. 1.
Figure 13B:
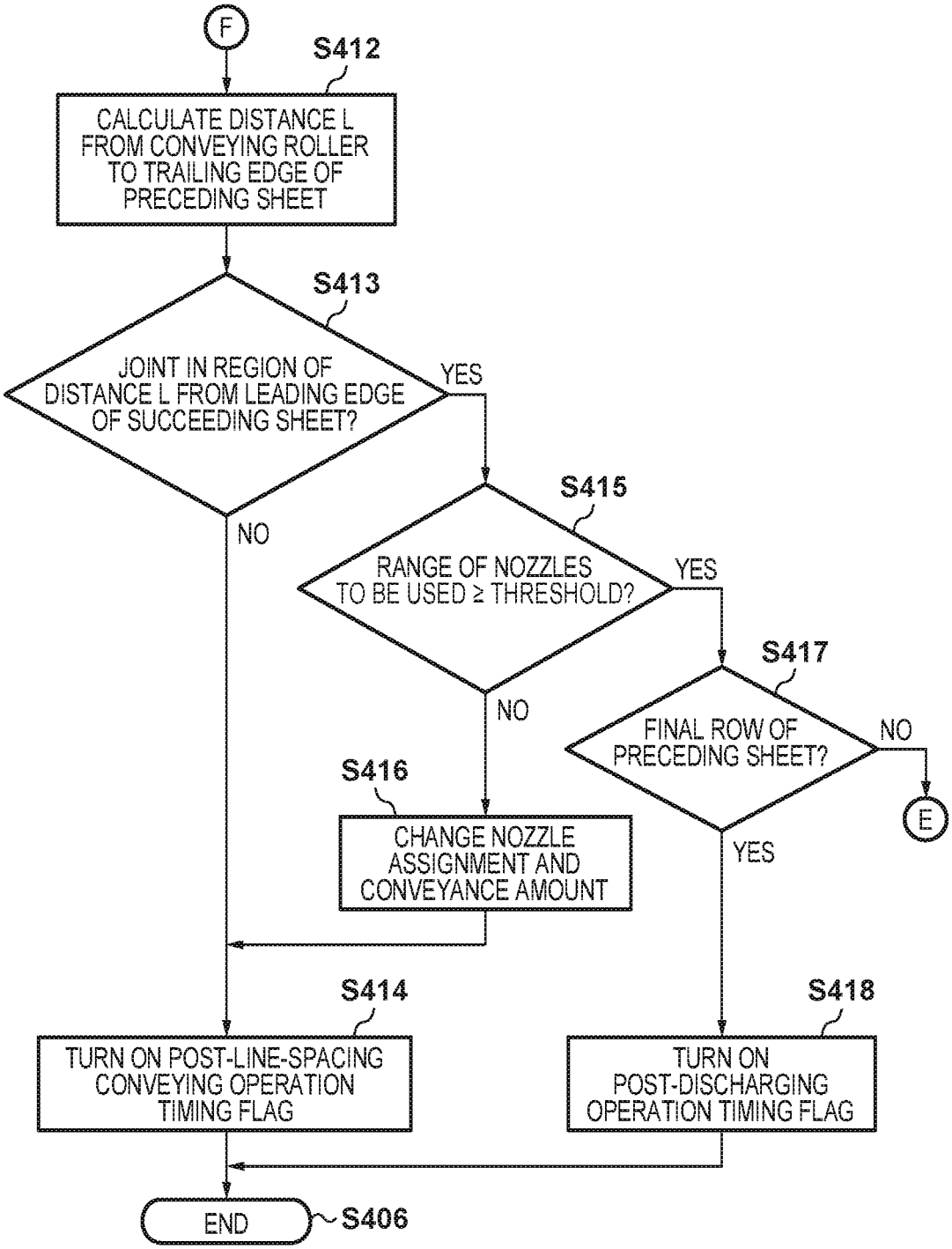

FIGS. 13A and 13B are flowcharts showing still another example of setting processing in step S14. Like FIG. 12, FIGS. 13A and 13B show an example in which the condition of the remaining print range is set to two rows. The processes of steps S402 to S405 and S407 to S409 in FIG. 13A are the same as the processes of steps S302 to S305 and S307 to S309 in FIG. 12, and will briefly be described.

In this embodiment, an example in which an influence on image formation on the succeeding sheet 1-B will be described. Here, not only setting of the execution timing of the skew correction operation of the succeeding sheet 1-B but also a print mode within the range of a predetermined length from the leading edge of the succeeding sheet 1-B is taken into consideration. An example in which considering the arrangement mode of print scan as the print mode, the conveyance amount and nozzles to be used in the printing operation of the succeeding sheet 1-B can be changed will be described.

FIGS. 13A and 13B are flowcharts showing still another example of setting processing in step S14. Like FIG. 12, FIGS. 13A and 13B show an example in which the condition of the remaining print range is set to two rows. The processes of steps of steps S402 to S405 and S407 to S409 in FIG. 13A are the same as the processes of steps S302 to S305 and S307 to S309 in FIG. 12, and will briefly be described.

In step S401, the processing starts. In step S402, it is determined whether the condition to set the execution timing of the skew correction operation for the succeeding sheet 1-B is met. In this example, it is determined whether the remaining print range includes two rows. If the condition is met, the process advances to step S403. If the condition is not met, the printing operation of the preceding sheet 1-A is continued.

In steps S403 to S418, the execution timing of the skew correction operation for the succeeding sheet 1-B is set based on the positions of the preceding sheet 1-A and the succeeding sheet 1-B and the print mode for the succeeding sheet 1-B.

In step S403, it is determined whether the leading edge of the succeeding sheet 1-B has reached a determination position (a position P3 in a state ST15 shown in FIG. 8). If the leading edge of the succeeding sheet 1-B has not reached the determination position (NO in step S403), it is determined whether the printing operation of the preceding sheet 1-A is performed for the last row (step S404). Upon determining that the printing operation of the preceding sheet 1-A is not performed for the last row (NO in step S404), the printing operation of the preceding sheet 1-A is continued, and the process returns to step S403.

If the printing operation of the preceding sheet 1-A is performed for the last row (YES in step S404), there is some question as to whether the leading edge of the succeeding sheet 1-B abuts against the conveying nip portion by the conveyance of a predetermined amount. For this reason, it is determined not to execute overlap continuous feeding, the post-discharging operation timing flag is turned on (step S405), and the setting processing ends (step S406).

If the leading edge of the succeeding sheet 1-B has reached the determination position (P3 in the state ST15 in FIG. 8) (YES in step S403), it is determined whether the trailing edge of the preceding sheet 1-A has passed through the conveying nip portion (step S407). Upon determining that the trailing edge of the preceding sheet 1-A has passed through the conveying nip portion (YES in step S407), the preceding sheet 1-A and the succeeding sheet 1-B do not overlap. The printing operation of the last row of the preceding sheet 1-A or the row immediately before the last row is yet to be performed. Hence, the post-line-spacing conveying operation timing flag is turned on in step S408, and the setting processing ends.

Upon determining that the trailing edge of the preceding sheet 1-A has not passed through the conveying nip portion (NO in step S407), it is determined whether the overlap amount between the trailing edge portion of the preceding sheet 1-A and the leading edge portion of the succeeding sheet 1-B is smaller than a threshold (step S409).

Upon determining that the overlap amount is smaller than the threshold (YES in step S409), it is determined whether the printing operation of the preceding sheet 1-A is performed for the last row (step S410). Upon determining that the printing operation of the preceding sheet 1-A is not performed for the last row (NO in step S410), the printing operation of the preceding sheet 1-A is continued, and the process returns to step S407. Upon determining that the printing operation of the preceding sheet 1-A is performed for the last row (YES in step S410), it is determined not to execute overlap continuous feeding, the post-discharging operation timing flag is turned on (step S411), and the setting processing ends (step S406).

Figure 14:
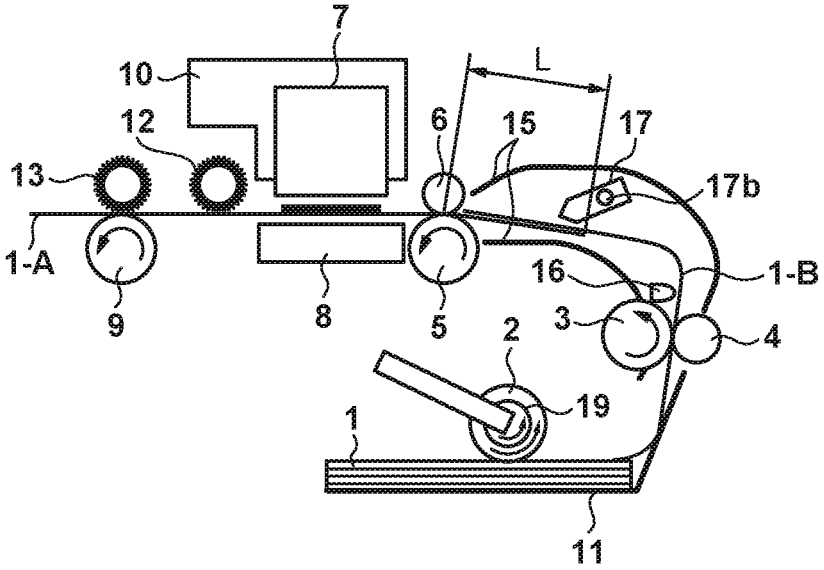
FIG. 14 is an explanatory view of a length L.

Upon determining that the overlap amount is equal to or larger than the threshold (NO in step S409), a distance L from the conveying roller 5 (conveying nip portion) to the trailing edge of the preceding sheet 1-A is calculated in step S412. FIG. 14 is an explanatory view of the distance L. If the skew correction operation of the succeeding sheet 1-B is executed in the state shown in FIG. 14, the preceding sheet 1-A and the succeeding sheet 1-B overlap by a length corresponding to the distance L in the conveying direction. That is, the distance L represents a region where the preceding sheet 1-A and the succeeding sheet 1-B pass through the conveying nip portion in the overlap state. The distance L can be calculated from, for example, the conveyance amount of the preceding sheet 1-A from alignment and the logical paper length.

If overlap continuous feeding is performed by making the preceding sheet 1-A and the succeeding sheet 1-B overlap by the length corresponding to the distance L, the range of the length corresponding to the distance L from the leading edge of the succeeding sheet 1-B in the conveying direction can be influenced by a conveyance error caused by the overlap continuous feeding. The conveyance error influences image quality depending on the print mode in this range. In particular, the conveyance error readily has an influence depending on the arrangement mode of print scan during the conveyance of the succeeding sheet 1-B. For example, in an arrangement mode in which print scan processes adjacent in the conveying direction continue, if a conveyance error occurs, a black stripe or a white stripe may appear at the joint between the adjacent print scan processes. This will be described in more detail with reference to FIGS. 15A to 15D.

Figure 15A:
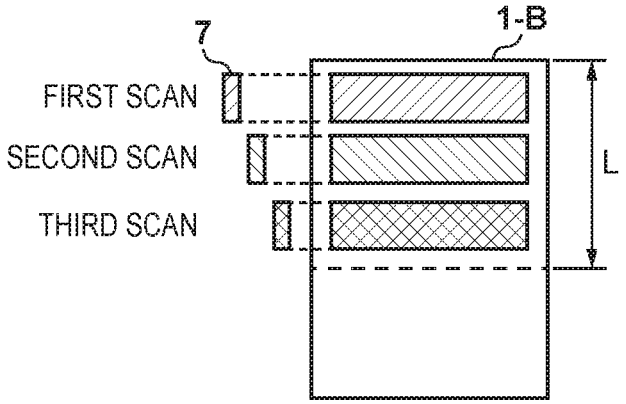
FIGS. 15A to 15D are explanatory views of joints, nozzle assignment change, and conveyance amount change.

FIG. 15A shows a state in which the region of the distance L from the leading edge of the succeeding sheet 1-B includes no joint where the print scan processes tightly continue. Since the print scan processes (first scan, second scan, and third scan) in the region of the distance L from the leading edge are spaced part from each other, and no joint exists, neither a black stripe nor a white stripe appears even if a conveyance error occurs between the print scan processes.

Figure 15B:
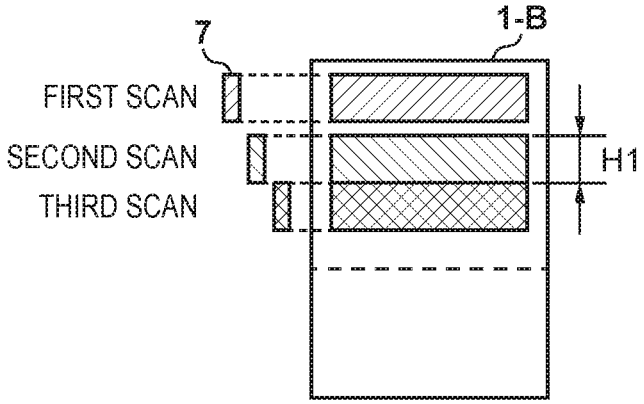

In FIG. 15B, no gap is formed between the second scan and the third scan, and a joint where the third scan continues to the second scan is formed. If a conveyance error exists when conveying the succeeding sheet 1-B from the position of the second scan to the position of the third scan, the position of the second scan and the position of the third scan may overlap or separate. The former results in a black stripe, and the latter results in a white stripe. To prevent this, prohibiting overlap continuous feeding is advantageous.

The succeeding sheet 1-B is conveyed by a distance H1 between the second scan and the third scan. The distance H1 corresponds to the nozzle length of a printhead 7. The conveyance error becomes worse in proportion to the conveyance amount of the preceding and succeeding sheets passing through the conveying nip portion in the overlap state. Conversely, if the conveyance amount of the preceding and succeeding sheets passing through the conveying nip portion in the overlap state is small, the conveyance error can be reduced.

Figure 15C:
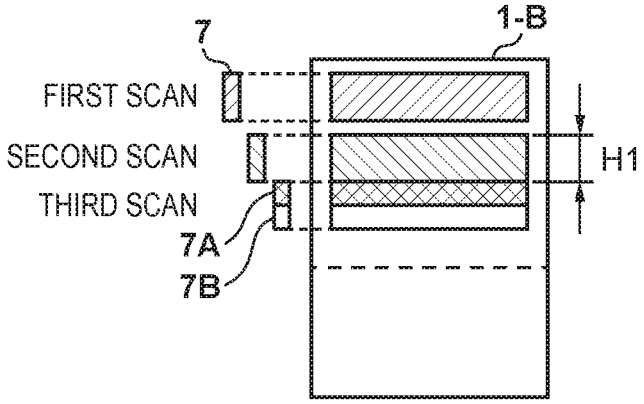
Figure 15D:
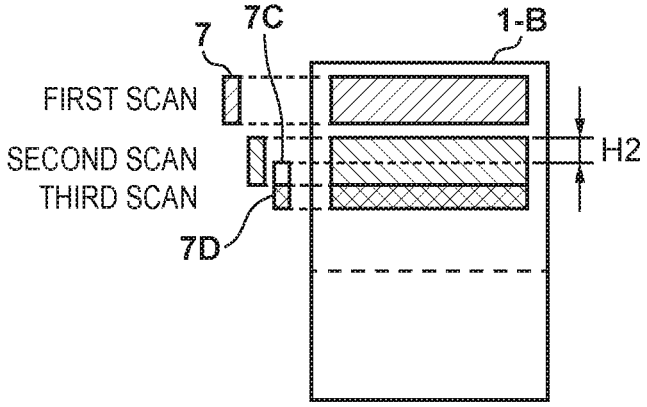

Hence, if the use range of nozzles used in the third scan in the conveying direction is small, as shown in FIG. 15C, the conveyance amount can be reduced from H1 to H2 (<H1) by changing assignment of the nozzles to be used, as shown in FIG. 15D. This contributes to reduction of the conveyance error.

The example shown in FIG. 15C assumes a case in which a use range 7A of nozzles used in the third scan is 50% of nozzles located on the upstream side of the printhead 7. Nozzles in a range 7B are not scheduled to be used in the third scan. The use range of nozzles to be used in the third scan is changed to a range 7D corresponding to 50% of nozzles located on the downstream side of the printhead 7, as shown in FIG. 15D. That is, in the example shown in FIGS. 15C and 15C, the use range 7A is changed to a disuse range 7C, and the disuse range 7B is changed to the use range 7D.

In addition, the conveyance amount of the succeeding sheet 1-B is changed from H1 to H2 (=0.5×H1) between the second scan and the third scan. Since the conveyance amount changes to ½, the conveyance error also changes to about ½, and generation of a black stripe or white stripe can be reduced.

In this embodiment, the use range of the nozzles is compared with a threshold. If the use range exceeds the threshold (also called a nozzle threshold), the assignment of the nozzles to be used is changed, and the conveyance amount of the succeeding sheet 1-B is changed. The nozzle threshold can appropriately be set in accordance with the nozzle length of the printhead 7 or the conveyance amount that causes image quality degradation when the preceding and succeeding sheets are passed through the conveying nip portion in the overlap state. For example, if a black stripe or white stripe is generated by conveying the sheets by a distance of 0.7×H1 relative to the nozzle length H1 of the printhead 7, the nozzle threshold is set such that the conveyance amount is suppressed to be smaller than 0.7×H1. In this case, whether the nozzle use range is 70% or more from the upstream side is set to the nozzle threshold. If the use range is less than 70%, the assignment of the nozzles to be used or the conveyance amount is changed. If the use range is 70% or more, overlap continuous feeding is not performed.

Referring back to FIG. 13B, in step S413, it is determined based on the print data of the succeeding sheet 1-B whether a joint exemplified in FIG. 15B or the like exists in the region of the distance L from the leading edge of the succeeding sheet 1-B. If a joint exists, the process advances to step S415. If a joint does not exist (in the print mode exemplified in FIG. 15A), the process advances to step S414.

In step S414, the post-line-spacing conveying operation timing flag is turned on, and the setting processing ends. The skew correction operation of the succeeding sheet 1-B is performed during image formation of the row immediately before the last row or during image formation of the last row.

In step S415, it is determined whether the use range of the nozzles in the joint is equal to or more than the nozzle threshold. If the use range is less than the nozzle threshold, the process advances to step S416. If the use range is equal to or more than the nozzle threshold, the process advances to step S417. In step S416, the assignment of the nozzles to be used in the joint is changed, and the conveyance amount of the succeeding sheet 1-B up to the print scan of the joint is changed. After that, the process advances to step S414. The post-line-spacing conveying operation timing flag is turned on, and the setting processing ends. That is, although the joint exists on the succeeding sheet 1-B, generation of a black stripe or white stripe can be prevented by changing the conveyance amount of the succeeding sheet 1-B up to the print scan of the joint, and therefore, overlap continuous feeding is executed.

In step S417, it is determined whether the printing operation of the preceding sheet 1-A is performed for the last row. Upon determining that the printing operation of the preceding sheet 1-A is not performed for the last row (NO in step S417), the printing operation of the preceding sheet 1-A is continued, and the process returns to step S407. Upon determining that the printing operation of the preceding sheet 1-A is performed for the last row (YES in step S417), it is determined not to execute overlap continuous feeding, the post-discharging operation timing flag is turned on (step S418), and the setting processing ends.

As described above, according to the third embodiment, it is possible to perform the skew correction operation of the succeeding sheet 1-B during the printing operation of the preceding sheet 1-A while reducing lowering of conveyance accuracy of the succeeding sheet 1-B. In addition, the print sheets can be conveyed in an overlap state during the printing operation. As a result, the print speed can be improved while maintaining image quality.

Fourth Embodiment

In the third embodiment, a form in which the existence of a joint in the print contents of the succeeding sheet 1-B or the nozzles to be used in the joint are determined, thereby reducing lowering of the conveyance accuracy of the succeeding sheet 1-B has been described. In the fourth embodiment, the concept of the third embodiment is applied to printing of a preceding sheet 1-A.

Figure 16A:
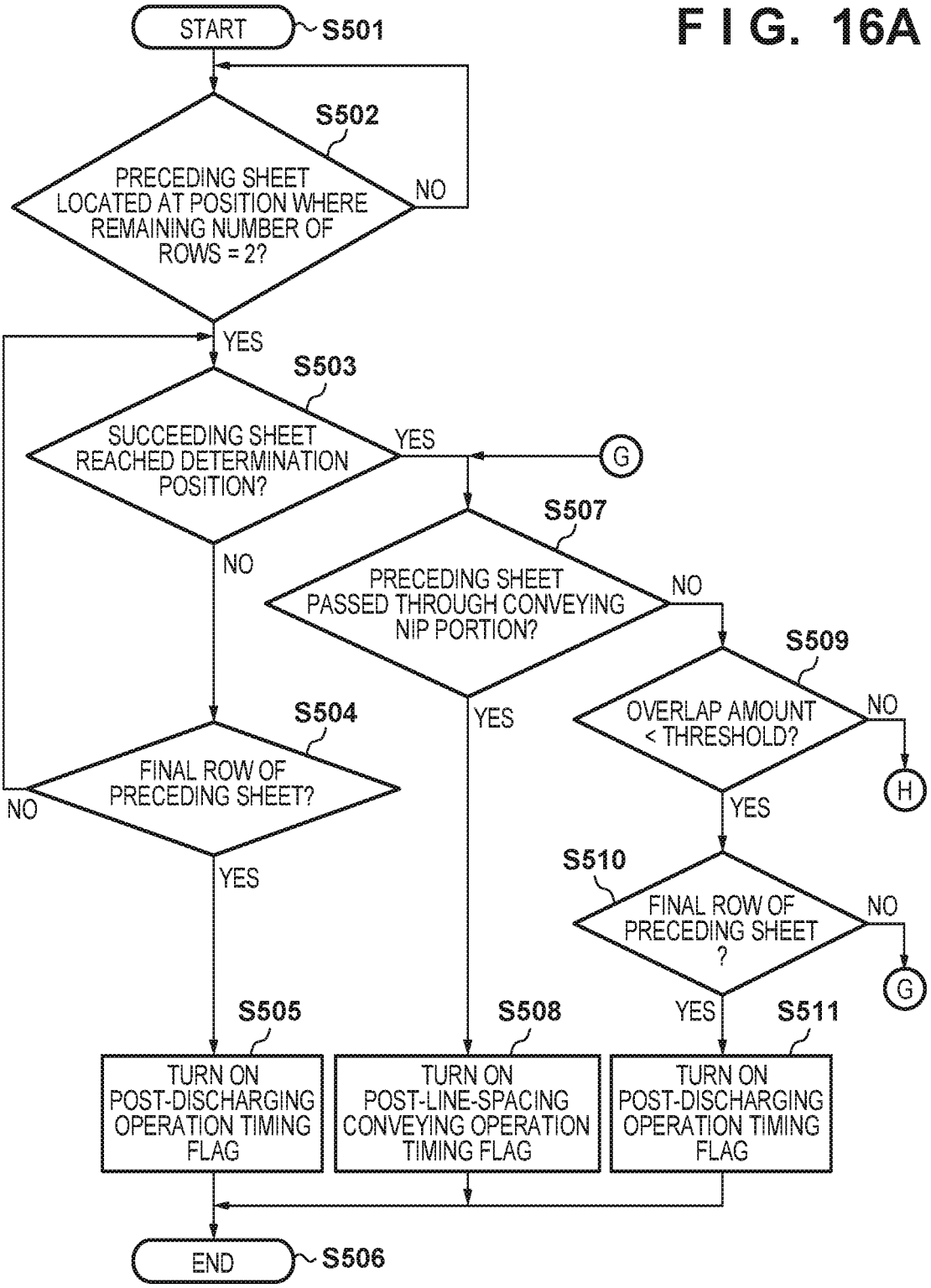
FIGS. 16A and 16B are flowcharts showing an example of processing executed by the control unit of the printing apparatus shown in FIG. 1.
Figure 16B:
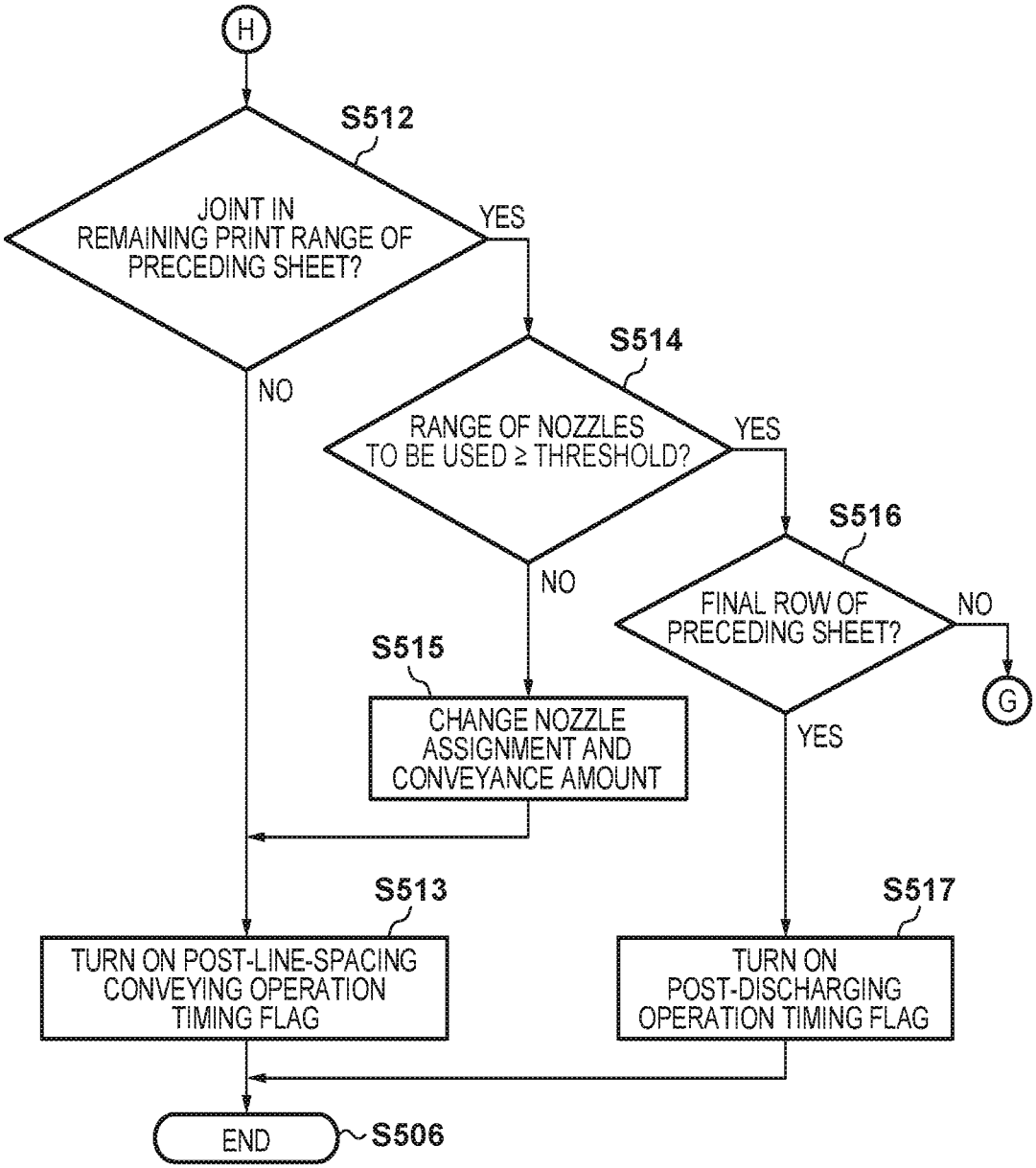

FIGS. 16A and 16B are flowcharts showing still another example of setting processing in step S14. The example shown in FIGS. 16A and 16B is basically the same as the example shown in FIGS. 13A and 13B except that the processing target of the processes of steps S413, S415, and S416 is the preceding sheet 1-A (steps S512, S514, S515).

In step S501, the processing starts. In step S502, it is determined whether the condition to set the execution timing of the skew correction operation for a succeeding sheet 1-B is met. In this example, it is determined whether the remaining print range includes two rows. If the condition is met, the process advances to step S503. If the condition is not met, the printing operation of the preceding sheet 1-A is continued.

In steps S503 to S517, the execution timing of the skew correction operation for the succeeding sheet 1-B is set based on the positions of the preceding sheet 1-A and the succeeding sheet 1-B and the print mode for the succeeding sheet 1-B.

In step S503, it is determined whether the leading edge of the succeeding sheet 1-B has reached a determination position (a position P3 in a state ST15 shown in FIG. 8). If the leading edge of the succeeding sheet 1-B has not reached the determination position (NO in step S503), it is determined whether the printing operation of the preceding sheet 1-A is performed for the last row (step S504). Upon determining that the printing operation of the preceding sheet 1-A is not performed for the last row (NO in step S504), the printing operation of the preceding sheet 1-A is continued, and the process returns to step S503.

If the printing operation of the preceding sheet 1-A is performed for the last row (YES in step S504), there is some question as to whether the leading edge of the succeeding sheet 1-B abuts against the conveying nip portion by the conveyance of a predetermined amount. For this reason, it is determined not to execute overlap continuous feeding, the post-discharging operation timing flag is turned on (step S505), and the setting processing ends (step S506).

If the leading edge of the succeeding sheet 1-B has reached the determination position (P3 in the state ST15 in FIG. 8) (YES in step S503), it is determined whether the trailing edge of the preceding sheet 1-A has passed through the conveying nip portion (step S507). Upon determining that the trailing edge of the preceding sheet 1-A has passed through the conveying nip portion (YES in step S507), the preceding sheet 1-A and the succeeding sheet 1-B do not overlap. The printing operation of the last row of the preceding sheet 1-A or the row immediately before the last row is yet to be performed. Hence, the post-line-spacing conveying operation timing flag is turned on in step S508, and the setting processing ends.

Upon determining that the trailing edge of the preceding sheet 1-A has not passed through the conveying nip portion (NO in step S507), it is determined whether the overlap amount between the trailing edge portion of the preceding sheet 1-A and the leading edge portion of the succeeding sheet 1-B is smaller than a threshold (step S509).

Upon determining that the overlap amount is smaller than the threshold (YES in step S509), it is determined whether the printing operation of the preceding sheet 1-A is performed for the last row (step S510). Upon determining that the printing operation of the preceding sheet 1-A is not performed for the last row (NO in step S510), the printing operation of the preceding sheet 1-A is continued, and the process returns to step S507. Upon determining that the printing operation of the preceding sheet 1-A is performed for the last row (YES in step S510), it is determined not to execute overlap continuous feeding, the post-discharging operation timing flag is turned on (step S511), and the setting processing ends (step S506).

Upon determining that the overlap amount is equal to or larger than the threshold (NO in step S509), it is determined based on the print data of the preceding sheet 1-A whether a joint exemplified in FIG. 15B or 15C exists in the remaining print range of the preceding sheet 1-A. If a joint exists, a conveyance error caused by overlap continuous feeding later may have an influence. If a joint exists, the process advances to step S514. If a joint does not exist, the process advances to step S513.

In step S513, the post-line-spacing conveying operation timing flag is turned on, and the setting processing ends. The skew correction operation of the succeeding sheet 1-B is performed during image formation of the row immediately before the last row or during image formation of the last row.

In step S514, it is determined whether the use range of the nozzles in the joint is equal to or more than a nozzle threshold. If the use range is less than the nozzle threshold, the process advances to step S515. If the use range is equal to or more than the nozzle threshold, the process advances to step S516. In step S515, the assignment of the nozzles to be used in the joint is changed, and the conveyance amount of the preceding sheet 1-A up to the print scan of the joint is changed. After that, the process advances to step S513. The post-line-spacing conveying operation timing flag is turned on, and the setting processing ends. That is, although the joint exists on the preceding sheet 1-A, generation of a black stripe or white stripe can be prevented by changing the conveyance amount of the preceding sheet 1-A up to the print scan of the joint, and therefore, overlap continuous feeding is executed. The changed contents in step S515 are reflected on the printing operation during the period when the preceding sheet 1-A and the succeeding sheet 1-B pass through the conveying nip portion in a state in which the trailing edge portion of the preceding sheet 1-A and the leading edge portion of the succeeding sheet 1-B overlap.

In step S516, it is determined whether the printing operation of the preceding sheet 1-A is performed for the last row. Upon determining that the printing operation of the preceding sheet 1-A is not performed for the last row (NO in step S516), the printing operation of the preceding sheet 1-A is continued, and the process returns to step S507. Upon determining that the printing operation of the preceding sheet 1-A is performed for the last row (YES in step S516), it is determined not to execute overlap continuous feeding, the post-discharging operation timing flag is turned on (step S517), and the setting processing ends.

As described above, according to the fourth embodiment, it is possible to perform the skew correction operation of the succeeding sheet 1-B during the printing operation of the preceding sheet 1-A while reducing lowering of conveyance accuracy of the preceding sheet 1-A. In addition, the print sheets can be conveyed in an overlap state during the printing operation. As a result, the print speed can be improved while maintaining image quality.

Fifth Embodiment

The third embodiment and the fourth embodiment may be combined. That is, the presence/absence of a joint in the print range or nozzles to be used in the joint may be determined for both a preceding sheet 1-A and a succeeding sheet 1-B, and the nozzles to be used and the conveyance amount of each print sheet 1 may be changed.

The setting of the execution timing of the skew correction operation of the succeeding sheet 1-B according to each embodiment may be done based on the type of the succeeding sheet 1-B. For example, processing concerning the nozzle change or conveyance amount change described in the third or fourth embodiment may be performed or prohibited depending on the type of the print sheet 1. High-quality special paper or paper used for a pamphlet or the like is thicker than plain paper. Hence, the conveyance amount difference between conveyance of one paper sheet and conveyance of two paper sheets in a nipped state is large. If conveyance is performed using the same conveyance amount, image quality may be degraded by a black stripe or white stripe. For this reason, the type of the print sheet 1 may be determined based on driver information or user setting and the processing may be switched.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2016-102760, filed May 23, 2016, which is hereby incorporated by reference herein in its entirety.

What is claimed is:

1. A printing apparatus comprising:

a feeding roller configured to feed a sheet;

a pair of conveying rollers configured to nip and convey the sheet fed by the feeding roller;

a printhead configured to perform a printing operation on the sheet conveyed by the pair of conveying rollers;

a carriage configured to mount the printhead and move in a direction crossing a conveying direction of the sheet; and a control unit configured to execute a skew correction operation of causing a leading edge of a succeeding sheet to abut against the pair of conveying rollers which nips a preceding sheet and is stopped to perform a print scan of the carriage for the preceding sheet before a last print scan of the carriage for the preceding sheet, wherein the control unit executes, after the skew correction operation, a conveying operation of causing the pair of conveying rollers to nip an overlap portion where the preceding sheet and the succeeding sheet overlap with each other and conveying the succeeding sheet toward a printing start position where the printing operation starts, wherein the printhead comprises a plurality of nozzles arranged in the conveying direction and configured to discharge ink, and wherein in a case in which the printing operation for the preceding sheet is performed in a state in which the overlap portion is conveyed by the pair of conveying rollers, if there is no gap, in the conveying direction, between a first image printed by a first print scan of the carriage and a second image printed by a second print scan of the carriage next to the first print scan on the preceding sheet, the control unit changes nozzles of the plurality of nozzles for printing the first image and/or nozzles of the plurality of nozzles for printing the second image.

2. The apparatus according to claim 1, wherein if there is no gap between the first image and the second image and the number of the nozzles for printing the second image is less than a threshold, the control unit controls the number of the nozzles for printing the first image so that the number of nozzles for printing the first image is less than the number of the nozzles for printing the second image.

3. A printing apparatus comprising:

a feeding roller configured to feed a sheet;

a pair of conveying rollers configured to nip and convey the sheet fed by the feeding roller;

a printhead configured to perform a printing operation on the sheet conveyed by the pair of conveying rollers;

a carriage configured to mount the printhead and move in a direction crossing a conveying direction of the sheet; and a control unit configured to execute a skew correction operation of causing a leading edge of a succeeding sheet to abut against the pair of conveying rollers which nips a preceding sheet and is stopped to perform a print scan of the carriage for the preceding sheet before a last print scan of the carriage for the preceding sheet, wherein the control unit executes, after the skew correction operation, a conveying operation of causing the pair of conveying rollers to nip an overlap portion where the preceding sheet and the succeeding sheet overlap with each other and conveying the succeeding sheet toward a printing start position where the printing operation starts, wherein the printhead comprises a plurality of nozzles arranged in the conveying direction and configured to discharge ink, and wherein in a case in which the printing operation for the preceding sheet is performed in a state in which the overlap portion is conveyed by the pair of conveying rollers, if there is no gap, in the conveying direction, between a first image printed by a first print scan of the carriage and a second image printed by a second print scan of the carriage next to the first print scan on the preceding sheet, the control unit changes a first conveyance amount, which is a last conveyance amount of the preceding sheet before printing the first image, and/or a second conveyance amount, which is a last conveyance amount of the preceding sheet before printing the second image.

4. The apparatus according to claim 3, wherein if there is no gap between the first image and the second image and the number of the nozzles for printing the second image is less than a threshold, the control unit controls the first conveyance amount so that the first conveyance amount is less than the second conveyance amount.

* * * * *